US005881511A

United States Patent [19]

Keller, Jr.

[11] Patent Number: 5,881,511

[45] Date of Patent: Mar. 16, 1999

[54] CONCRETE BUILDING BLOCK ASSEMBLY

[76] Inventor: Fred Keller, Jr., 242 Flagstone Dr., Bethlehem, Pa. 18017

[21] Appl. No.: 796,802

[22] Filed: Feb. 6, 1997

[51] Int. Cl.[6] ..... E04B 2/02

[52] U.S. Cl. ..... 52/220.2; 52/286; 52/564; 52/568; 52/570; 52/572; 52/574; 52/586.1; 52/590.2

[58] Field of Search ..... 52/220.2, 562, 52/564, 565, 568, 570, 572, 574, 604, 605, 286, 586.1, 590.1, 590.2; 405/286; 47/82, 83, 86, 65.5, 66

[56] References Cited

U.S. PATENT DOCUMENTS

| | | | |
|---|---|---|---|
| 802,903 | 10/1905 | Anderson . | |
| 1,097,148 | 5/1914 | Swanson . | |
| 1,167,746 | 1/1916 | Funsten . | |
| 1,244,008 | 10/1917 | Wheeler . | |
| 1,356,590 | 10/1920 | Baumann . | |
| 2,104,307 | 1/1938 | Miller | 52/590.1 X |
| 2,247,614 | 7/1941 | Lingenfelter . | |
| 2,624,193 | 1/1953 | Larson . | |
| 2,683,980 | 7/1954 | Krause . | |
| 2,792,704 | 5/1957 | Koolman . | |
| 2,884,780 | 5/1959 | Ramirez . | |
| 2,942,453 | 6/1960 | Kaul . | |
| 3,418,774 | 12/1968 | Kocher et al. . | |
| 3,817,013 | 6/1974 | Selby . | |
| 3,956,862 | 5/1976 | Alexandre, Jr. . | |
| 3,998,022 | 12/1976 | Muse . | |
| 3,999,349 | 12/1976 | Miele et al. . | |
| 4,003,172 | 1/1977 | Pawl | 52/590.1 X |
| 4,081,969 | 4/1978 | Clarke . | |
| 4,089,144 | 5/1978 | Astl | 52/568 X |
| 4,123,881 | 11/1978 | Muse . | |
| 4,134,241 | 1/1979 | Walton . | |
| 4,182,089 | 1/1980 | Cook . | |
| 4,524,551 | 6/1985 | Scheiwiller . | |
| 4,638,617 | 1/1987 | James . | |
| 4,694,624 | 9/1987 | Juhas . | |
| 4,704,832 | 11/1987 | Vassiliadis . | |
| 4,780,433 | 10/1988 | Keller, Jr. . | |
| 4,815,897 | 3/1989 | Risi . | |
| 4,825,619 | 5/1989 | Forsberg . | |
| 4,896,999 | 1/1990 | Ruckstuhl . | |
| 4,932,812 | 6/1990 | Schaaf . | |
| 5,122,015 | 6/1992 | Shen . | |
| 5,127,770 | 7/1992 | Ditcher . | |
| 5,163,261 | 11/1992 | O'Neill . | |
| 5,205,097 | 4/1993 | Harvey . | |
| 5,222,342 | 6/1993 | Defferrari | 52/604 X |
| 5,226,275 | 7/1993 | Trahan . | |
| 5,350,256 | 9/1994 | Hammer . | |

*Primary Examiner*—Robert Canfield
*Attorney, Agent, or Firm*—C. A. Wilkinson, Esq.; H. A. Wolin, Esq.

[57] ABSTRACT

A concrete block is provided having half dovetail sections at opposite ends of the block arranged so that when placed together the dovetailed sections on adjoining blocks form a full dovetailed section which is just large enough to be received within a dovetail groove in the central portion of an adjacent identical block. The concrete blocks are provided with upper and lower longitudinal grooves for longitudinal members having the same exterior shape. In one form of the invention one side of the block may be made into a plant receptacle by providing a hollowed out section oriented upwardly. Insulating concrete blocks may also be combined with blocks formed of structural concrete to provide an interlocked wall having a portion of the wall made from insulated concrete material and another portion of the wall made from structural concrete material.

15 Claims, 12 Drawing Sheets

Fig. 5
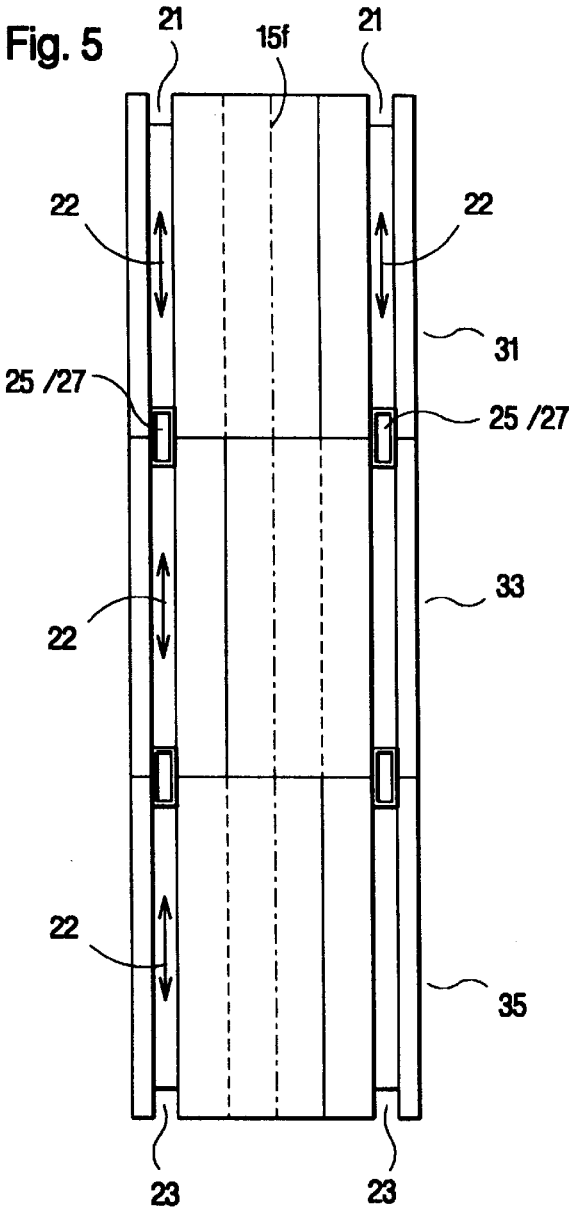
Fig. 5A
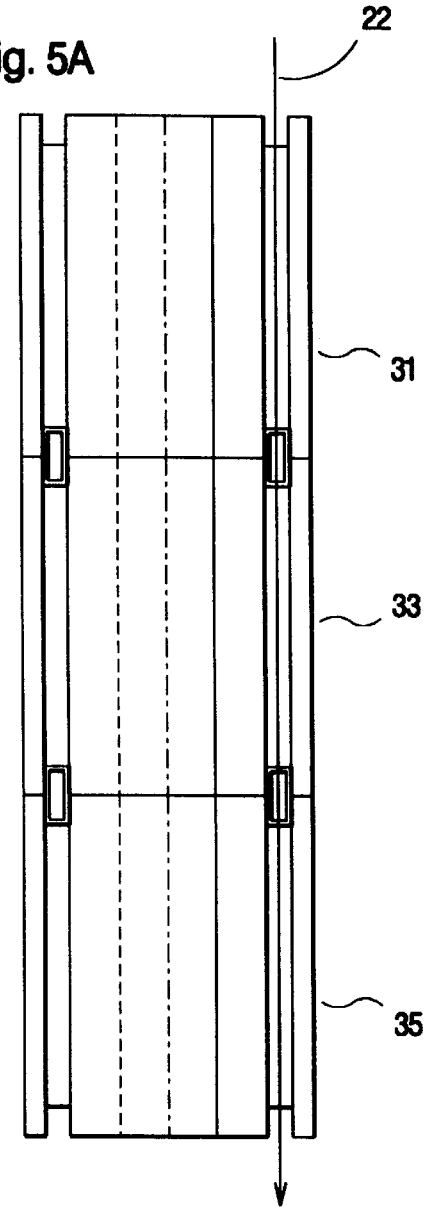
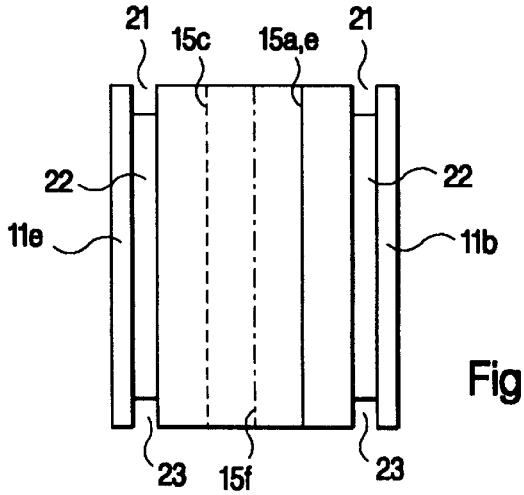
Fig. 4

Fig. 6
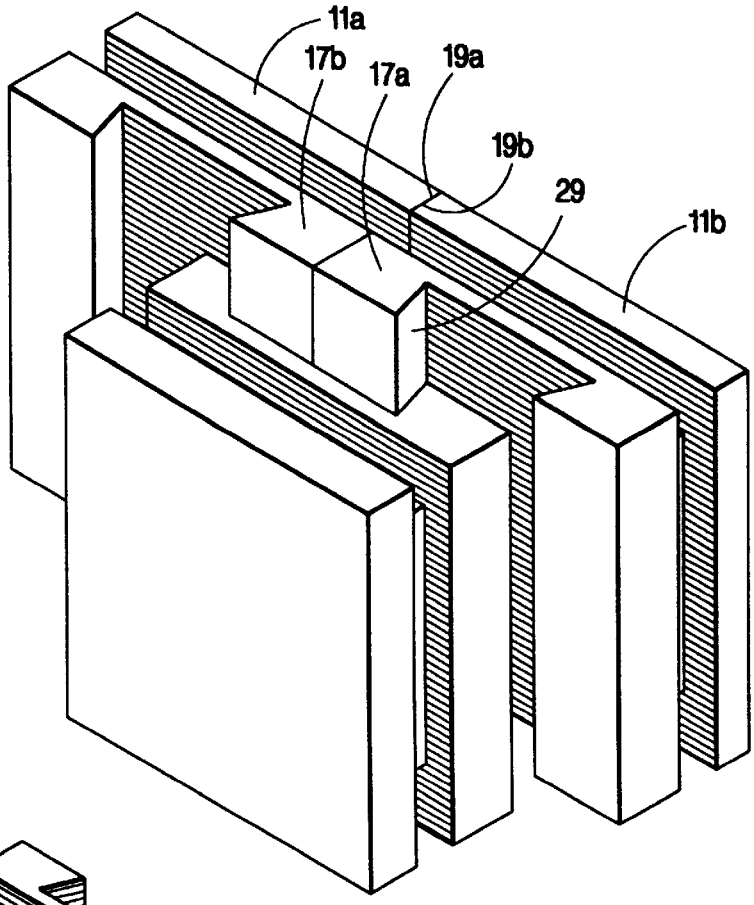
Fig. 7
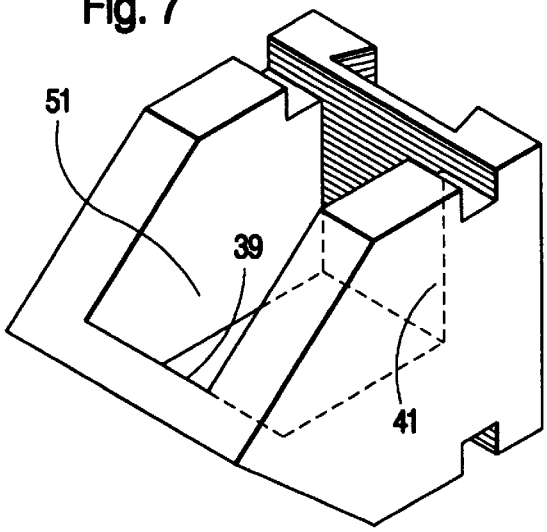
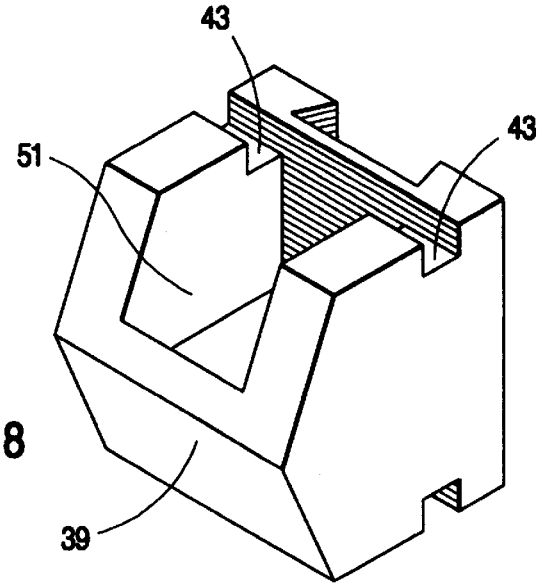
Fig. 8

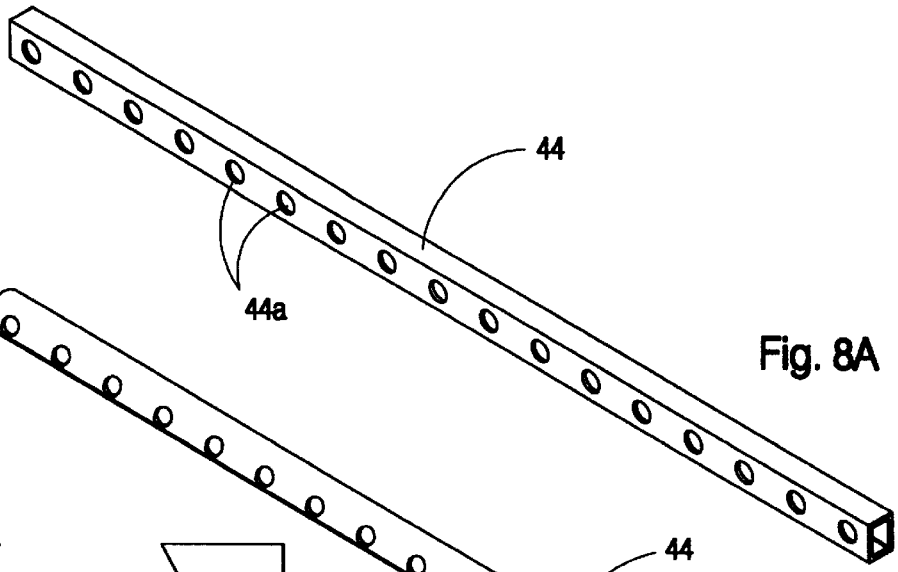
Fig. 8A
Fig. 8B
Fig. 9
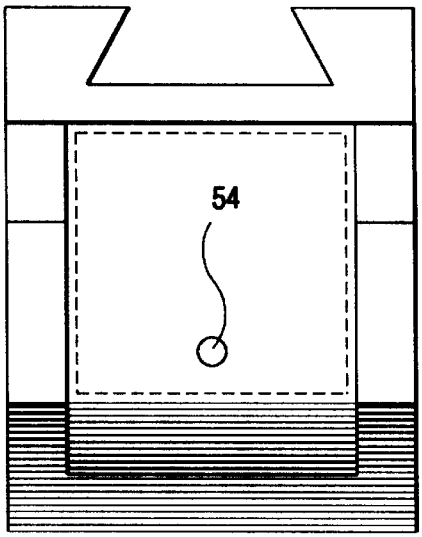
Fig. 11
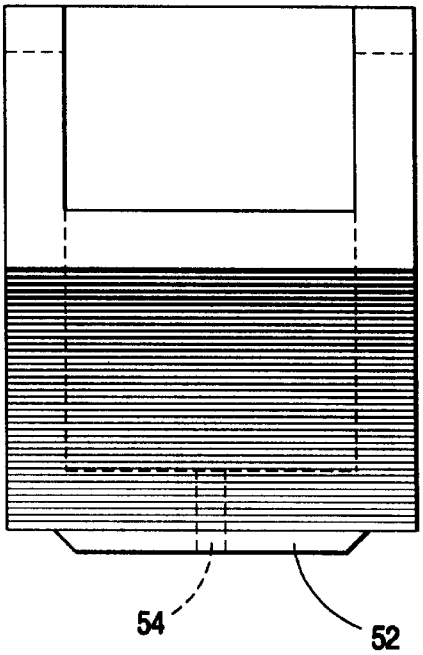
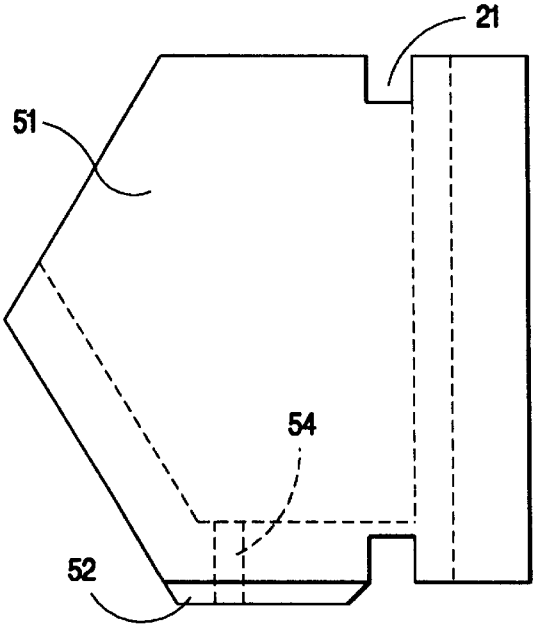
Fig. 10

Fig. 17
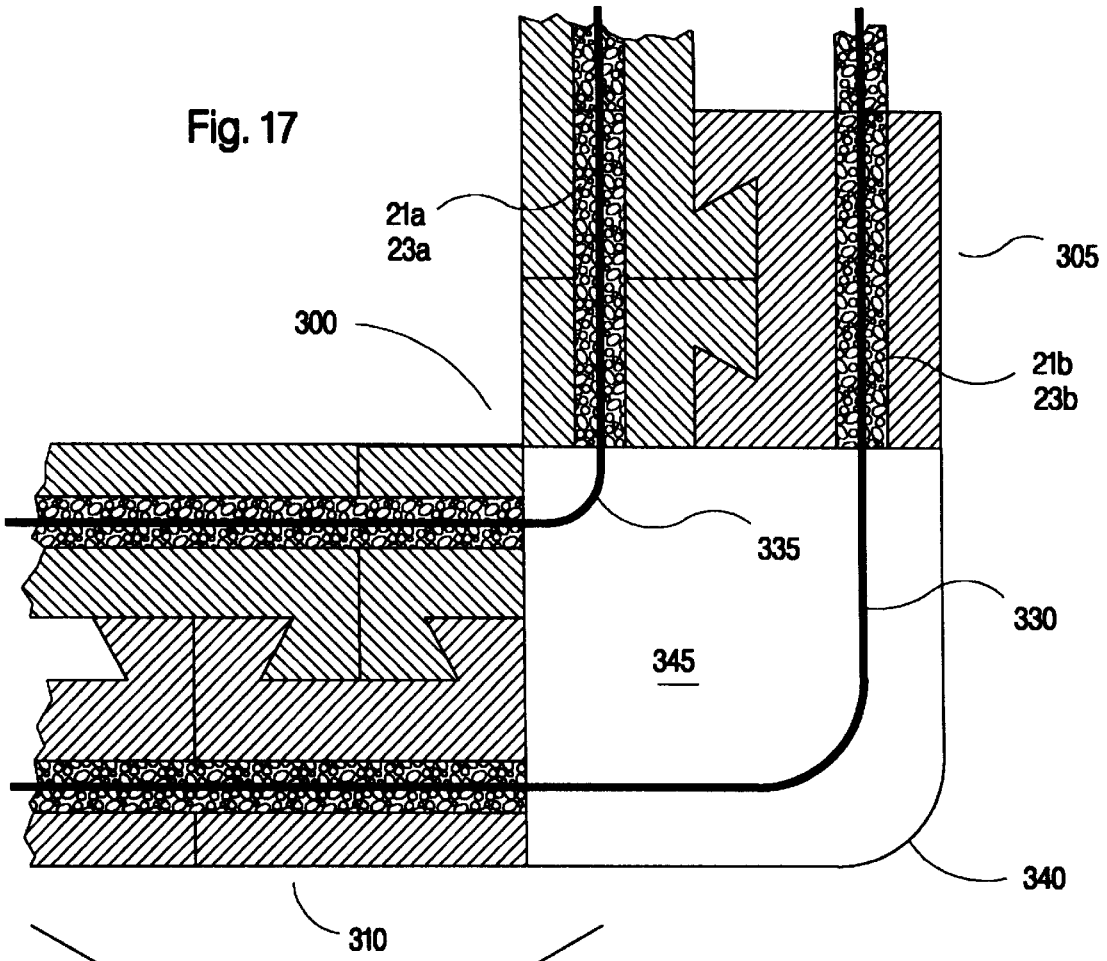
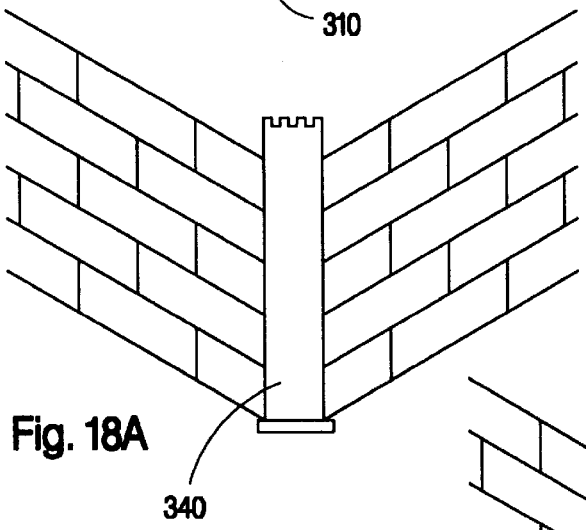
Fig. 18A
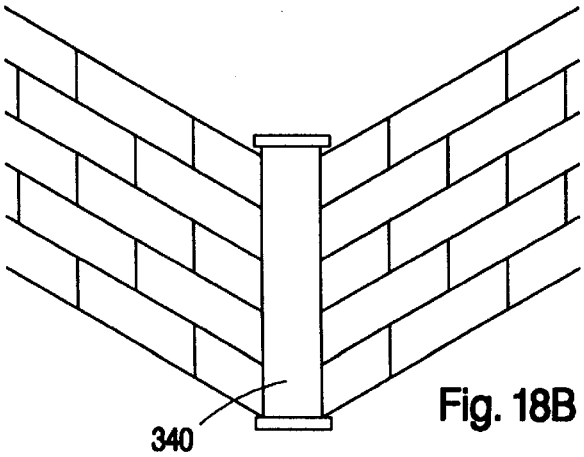
Fig. 18B

CONCRETE BUILDING BLOCK ASSEMBLY

BACKGROUND OF THE INVENTION

1. Field of the Invention

This invention relates to an improved concrete building block and walls, including retaining walls, built from a plurality of such building blocks. More particularly, the invention relates to interlocking concrete building blocks for forming walls, including retaining walls and insulated building walls.

2. Description of the Prior Art

Conventional eight inch by sixteen inch partially hollow concrete blocks have been used for many years to form walls and support structures. Such blocks are customarily secured together with mortar between the blocks, plus essentially the weight of the blocks which holds one row or course of blocks upon another. However, under severe loads such as in relatively elevated structures, and where there is exposure to shearing forces, such construction, unless reinforced in some manner, usually by being tied to a second parallel wall or structure of some form, is liable to collapse. Interlocking masonry or concrete blocks have been employed to lock together two parallel ceramic walls, but have not been too satisfactory due to excessive cost and weight, and such blocks must be made to rather precise tolerances in order to effectively interlock. In addition, such interlocking blocks have typically required additional grout or mortar as an adhesive or bonding medium.

Various methods for providing insulation in concrete walls have also been used in the past. These include pouring insulation within hollow blocks, placing insulation between two rows of blocks, placing layered insulation between thin layers of ceramic material interlocked into the overall form of a ceramic block, and the like. The use of insulating material incorporated directly into the ceramic material of a block has also been suggested, for example, in the present inventor's own U.S. Pat. No. 4,780,433 which discloses the incorporation into the concrete mix for a ceramic or concrete block of a light, ceramic aggregate derived from garbage and clay material. Such incorporation forms a lightweight, highly insulative block.

There have also been so-called garden blocks, or retaining wall blocks, in which a retaining wall is obtained by using a number of laterally expanded ceramic blocks having openings in one side of the top of the block in which plants may be placed. A "living" wall may be formed in this way in which strawberries, tomatoes, and flowers appear to climb up the wall, which is usually a retaining wall, but can also be the wall of a building.

As indicated above, the present inventor has received previous U.S. Pat. No. 4,780,433 issued Oct. 25, 1988 (the parent application of the present inventor's continuation-in-part application which is now U.S. Pat. No. 4,873,207) for an insulated ceramic building material formed of a mixture of cement, a so-called ceramic grog, plus ceramic aggregate beads, the grog and beads being mixtures of clay and a dried organic mulch material, the entire structure being porous after it is fired. The mixture is preferably up to three parts organic mulch material to one part clay, or in other words, 75% organic material and 25% clay material. The organic mixture is formed from burnable trash that, when fired, leaves small orifices in the clay mixture, which can then be mixed with cement to make porous insulating concrete.

The present inventor has found his block of the present invention to be particularly useful when made using his previously disclosed, porous insulating material, or partially of such material. However, his new block can equally well be formed from conventional concrete mixes which form an interlocking block which can be used with similar interlocking blocks to construct a variety of walls for building, as well as retaining walls which are either insulated or uninsulated.

When interlocking blocks are stacked, an inconsistency in the inherent dimensional tolerances between interlocking blocks becomes exaggerated throughout the wall from one interlock to the next, thereby amplifying the inconsistency and reducing the effectiveness of the interlock. The present inventor has recognized that a block with a square cross section, as opposed to a block with an elongated cross section in either the longitudinal or transverse direction, reduces and effectively overcomes inconsistencies brought about by differing tolerances inherent in the construction of the block. However, oblong-shaped blocks with minimal inconsistencies in tolerance would function in an equivalent manner.

There are both parallel vertical and parallel horizontal grooves designed into the sides of the block of the present invention which serve a variety of purposes. These grooves can accommodate supporting or stiffening pieces to reinforce the interlock between the blocks, can add places to incorporate additional insulation, serve as an internal network for electrical or piping conduits, or a combination of all three. The interlocking arrangement of the blocks in combination with the multi-directional grooved system creates a reinforced structure with a unique grid-type transmission system for wiring, cable, plumbing or the like.

The following prior patents disclose prior art concrete blocks developed with respect to interlocking blocks, blocks for retaining walls and insulating blocks and are exemplary of the type of blocks previously available in the art.

U.S. Pat. No. 802,903 issued Oct. 24, 1905 to Z. Anderson discloses an interlocking structure formed from tenon-shaped ribs, such structure requiring four different types (inner and outer side blocks plus inner and outer corner blocks) of blocks to form a complete wall. There are horizontal grooves dimensioned to receive the grasping ends of bonding irons in addition to mortar, and vertical grooves primarily for the insertion of mortar and other permanent bonding agents.

U.S. Pat. No. 1,097,148 issued May 19, 1914 to G. A. Swanson discloses an interlocking building block with interfitting corner blocks.

U.S. Pat. No. 2,683,980 issued Jul. 20, 1954 to W. Krause discloses an insulated building structure formed of a series of insulated blocks having grooves along the top and bottom surfaces with a longitudinal piece, or "lintel", extending between the ceramic or other blocks in the grooves. It is said that the longitudinal lintels, which may be of wood, metal or other materials, not only serve to align the blocks, but also to assist in securing them together.

U.S. Pat. No. 2,884,780 issued May 5, 1959 to T. C. Ramirez discloses a wall of interlocked blocks, each block consisting of a dovetail-shape arrangement on opposites sides of the block. An additional element is specially constructed to interlock at the end of the wall with the standard building blocks and provides for a vertical groove specifically disclosed for the transmission of utility conduits. The block of the present invention incorporates multi-dimensional grooves within its standard construction, unlike the Ramirez groove-bearing block which is distinct from its standard construction and specifically designed to provide the additional aspect of a groove only in a specific location along the wall.

U.S. Pat. No. 3,817,013 issued Jun. 18, 1974 to D. A. Selby discloses an insulated block made in two halves with a layer of insulation between them. The two halves of each block are held together by an interlocking keystone-shaped interconnection between the two halves of each block.

U.S. Pat. No. 4,081,969 issued Apr. 4, 1978 to W. L. Clarke discloses earth retaining wall constructions having leader and stretcher blocks arranged in tiered formation.

U.S. Pat. No. 4,524,551 issued Jun. 25, 1985 to R. Scheiwiller discloses construction units for the erection of walls and method of utilization wherein each unit is engaged to another unit through interlocking, longitudinal slots spanning the width of the units. The wall construction described herein is partially adapted for drywall construction and producing walls with sound proofing quality.

U.S. Pat. No. 4,638,617 issued Jan. 27, 1987 to B. R. James discloses a refractory curtain wall comprised of interlocking, self-supporting members suspended by a hanger member. The James reference does not disclose grooves within the interlocking members.

U.S. Pat. No. 4,815,897 issued Mar. 28, 1989 to A. Risi et al. discloses a retaining wall formed of interengaging blocks and ties, the interengaging parts being formed of rectangular grooves and extensions.

U.S. Pat. No. 4,825,619 issued May 2, 1989 to P. J. Forsberg discloses a block retaining wall comprised of superimposed units arranged in row formation. The blocks disclosed herein can be a plurality of shapes and are generally made of concrete.

U.S. Pat. No. 4,896,999 issued Jan. 30, 1990 to W. Ruckstuhl discloses a set of concrete building blocks for constructing a dry wall. Keystone-shaped projections extend from the base of the block. The patent specification refers to these projections as "dovetail-shaped". The dovetails are spaced along the edge of the blocks mostly along the interior perimeter. FIG. 4 of Ruckstuhl shows a "rectangular recess" described in the specification which transverses the height of the block. As disclosed, therein, the unusual purpose of the recess is to provide shelter for small animals. There are no grooves transversing the length of the block.

U.S. Pat. No. 4,932,812 issued Jun. 12, 1990 to C. F. Schaaf discloses an intermeshable construction unit wherein the units have interlocking teeth that form an interlock between two units. Similar to the above cited patents, no mortar is needed to facilitate the interlocking.

U.S. Pat. No. 5,122,015 issued Jun. 16, 1992 to C. J. Shen et al. discloses a construction assembly for a sea wall formed from a plurality of female and male block members. The female block has a semicircular recess across its length that, when adjacent another female member, forms a circular recess for the purpose of allowing water to pass through the wall. The Shen patent discloses a recess transversing the longitudinal dimension of the block, however, the purpose of the recess is to alleviate pressure from the wall by allowing water to pass through. Blocks are stacked one upon another by use of interlocking protrusions and grooves.

U.S. Pat. No. 5,127,770 issued Jul. 7, 1992 to J. Dichter et al. discloses a retaining wall assembly utilizing face panels interlocked with tieback/anchors. This invention dramatically reduces the overall weight of the assembly by eliminating the need for metallic reinforcing bars which are commonly employed in the prior art as support means.

U.S. Pat. No. 5,163,261 issued Nov. 17, 1992 to R. J. O'Neill discloses a retaining wall structure adapting interengaged support members. The support member has grooves uniformly spaced over its legs which allow for the superimposed structures to be vertically stacked on each other.

U.S. Pat. No. 5,205,097 issued Apr. 27, 1993 to G. L. Harvey discloses an interlocking pier assembly wherein blocks are vertically stacked and interconnected through rectangular recesses and interengaging longitudinal extrusions to support an overlying structure.

U.S. Pat. No. 5,226,275 issued Jul. 13, 1993 to D. H. Trahan discloses an interlocking block assembly for building purposes in which each block is connected to adjacent side blocks by a mortise and tenon arrangement having an expanded keystone interlocking shape, and is secured to upper or lower blocks by having lower external edges fit about a raised central portion of the block below. The composition of the blocks does not appear to be given, but based upon their shape, the thickness of the side walls, and the fact that insulation may be packed in the hollow central region, it may be a plastic resin composition of some form.

U.S. Pat. No. 5,350,256 issued Sep. 27, 1994 to J. Hammer discloses interlocking retaining walls, blocks and system. The drawings indicate the use of a keystone interlocking mechanism to provide structural stability for the wall by tying spaced concrete blocks together with longitudinal members.

There has been a need, therefore, for a well-designed, interlocking block that can be used essentially by itself with a number of other blocks to form a wall for a building or outdoor location, is self-locking, but easily assembled with other blocks, and is easily adapted to insulated construction. There has also been a need for an improved retaining wall block, including so-called "garden wall" blocks, that can be interlocked together to provide a structurally strong arrangement that can resist transverse forces on the side of the block in the case of a retaining wall block, and effectively contain living plants without overheating and instability in the case of garden wall blocks used to construct various walls such as the walls of buildings and the like.

OBJECTS OF THE INVENTION

It is an object of the present invention, therefore, to provide an efficient, sturdy concrete block.

It is a further object of the invention to provide a concrete block which is adaptable for use as both an insulated and uninsulated block.

It is a still further object of the invention to provide a concrete block that is self-aligning through the use of parallel, horizontal and parallel, vertical grooves or channels located circumferentially around the block.

It is a still further object of the invention to provide an interlocking block construction which uses a single block configuration to form the interior and exterior layers of an interlocking construction.

It is a still further object of the invention to provide an interlocking block construction that is easily and quickly made by placing together a series of identical interlocking blocks to form an interlocked wall.

It is a still further object of the invention to provide an interlocking block having interlocking extensions on the end of the block such that when two blocks are set together, they form together a dovetail arrangement which will fit into the central section between outer dovetails of an adjacent, but reversed, block.

It is a still further object of the invention to provide an interlocking arrangement wherein the outer ends of the block are flat for placement against other blocks, and a triangular interlocking tab extends from the face of the blocks forming a unitary extension which will fit into the central portion of overlapping reversed blocks.

It is a still further object of the invention to provide an interlocking block which, when interlocked with adjacent blocks, effectively seals any air crack through the wall by reason of a central portion of one block always being adjacent to a dividing seam between two other blocks.

It is a still further object of the invention to provide a unitary interlocking block which can be interlocked with other identical blocks in which once the interlocking is effected, such interlocking tends to prevent the blocks from coming apart while when the blocks are being interlocked, two blocks can be pressed towards each other to allow them easily to slide into a matching opening in an adjacent block.

It is a still further object of the invention to provide an easily interlocked block which tends to stay together once the interlock is effected.

It is a still further object of the invention to provide parallel, vertical and parallel, horizontal openings for the addition or subtraction of television, cable, telephone, electrical wires, and the like.

It is a still further object of the invention to provide an interlocking block which can be made in several designs, but which can always be interlocked with other similar designs to form a unitary wall.

It is a still further object of the invention to provide an interlocking block having an extension on one side, including a dish portion in the top of such side to hold plants.

It is a still further object of the invention to provide a wall made from insulating blocks interlocked together, in which one row of blocks is formed from ordinary structural concrete material while the other row of blocks interlocked with the first is formed from an insulating concrete mixture to provide both a structurally supported wall and an insulative wall.

It is a still further object of the invention to provide a garden block in which either the entire extension from one side, in which plants may be held, is formed from an insulating material.

It is a still further object of the invention to provide a garden block in which the opening provided in one side for plants is lined with an insulative concrete mixture to prevent excessive heat transmission to the roots of the plants.

It is a still further object of the invention to provide a garden block in which the upwardly oriented planter section is lined with an insulative plastic or other material to prevent eroding from the root system.

Other objects and advantages of the invention will become evident by a careful reading of the following description and explanation of the invention together with the appended drawings.

BRIEF DESCRIPTION OF THE INVENTION

An interlocking concrete or other ceramic block is provided in which one side of the block has extensions which abut the ends of the block extending outwardly at an angle on the inside, or side facing each other, and outwardly at right angles from the side of the block on the outside. Between the angled extensions on both ends of the block is a recess having the shape essentially of the inverse of two outward extensions on adjacent blocks. Such construction allows a single designer block to be used for an entire wall and allows easy assembly of the blocks together, while tending to prevent pulling them apart or, in other words, resists separation of the blocks. The horizontal and vertical sides of the block are provided with rectangular grooves which, when the blocks are assembled together with a longitudinal lintel between upper and lower blocks, prevents the blocks from moving sideways with respect to each other and therefore retains them together. The rectangular filler piece, or lintel will desirably be made from hollow plastic material and can therefore also be used as a conduit for electrical wires and other utilities such as, for example, water lines, particularly in the case of garden blocks. The vertical grooves can be used in conjunction with the horizontal grooves for the passage of conduits in the same manner, forming a network of passages within the interlocking wall structure resulting in a variety of conduit passage options.

BRIEF DESCRIPTION OF THE DRAWINGS

FIG. 4 is an end view of two rows of the blocks of the invention interlocked with each other showing the upper and lower rectangular recesses in such blocks in accordance with the invention.

FIG. 5 is an end view or cross section of a wall formed of a preferable, vertically staggered series of the interlocked blocks of the invention showing the openings provided for the rectangular lintels or interengaging linear members.

FIG. 5A is an end view or cross section of a wall formed of less preferred, vertically aligned series of the interlocked blocks of the invention showing the openings provided for the rectangular lintels or interengaging linear members.

FIG. 6 is a perspective view of three of the interlocking blocks of the invention being slid together into interlocking engagement.

FIG. 7 is an isometric view of a so-called garden block in accordance with the invention.

FIG. 8 is an isometric view of an alternate version of a garden block in accordance with the invention.

FIG. 8A is an isometric view of a rectangular configuration of a perforated lintel used in connection with the block of the invention.

FIG. 8B is an isometric view of a cylindrical configuration of a perforated lintel used in connection with the block of the invention.

FIG. 9 is a plan view of the garden block shown in FIG. 8.

FIG. 10 is a side view partially in phantom of the garden block shown in FIGS. 7 and 8.

FIG. 11 is a front view of the garden block shown in FIGS. 7 and 8.

FIG. 17 is a top view of a corner wall section in accordance with the invention.

FIGS. 18A and 18B are diagrammatic views of two potential corner arrangements when viewed from the exterior of the resultant interlocking, interengaging wall construction.

PREFERRED EMBODIMENTS OF THE INVENTION

Figure 1A:
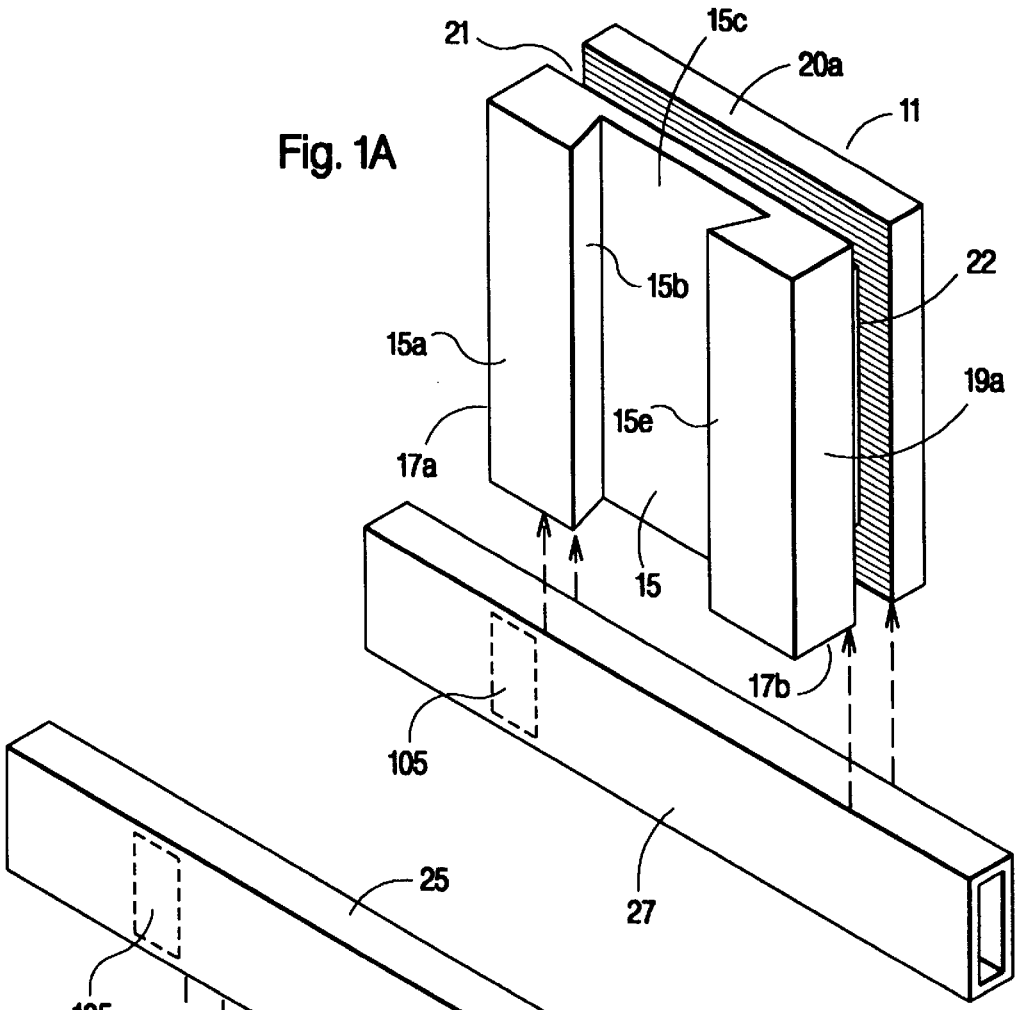
FIGS. 1A and 1B are isometric views of opposite sides of a concrete block in accordance with the present invention.

Interlocking concrete blocks have been previously developed to form stronger walls, which are not as subject to cracking as mortared concrete block walls, and which can more readily resist thrusting movements such as may be experienced in an earthquake or through some other externally applied force. Such interlocking blocks have tended to be more expensive than ordinary rectangular blocks, and the advantages gained have, in general, not outweighed the additional expense. Consequently, such blocks have not come into widespread use. Nevertheless, there are advantages to an interlocked wall of concrete blocks which, if a cheaper block could be developed, would make them preferable, particularly for structural use.

The present inventor has developed a new block which is not only economical, but more efficient to use than ordinary blocks. Such block can be made in a single basic form so that an entire wall may be formed from a series of such blocks. Furthermore, since the interlocking portions are always positioned at the end of the blocks and interact with end interlocking portions of two adjacent blocks, the block of the invention requires only the fabrication of a single block configuration, such single block configuration being repeatedly interlocked with other blocks of identical or similar configurations to form an entire wall. The wall constructed of the blocks of the invention may also incorporate hollow or other forms of lintels which are placed in preferably rectangular grooves on the top and bottom of the blocks so that said blocks are not only interlocked transversely with other similar blocks, but are also interengaged with upper and lower rows of the blocks.

In the present invention, the disposition of the interlocking or semi-dovetailed arrangement in which half of each dovetail comes from a different block and the two sections are butted together within the undercut section of an adjoining but reversed block allows the blocks to be interengaged at regular overlapping intervals using only one form of block. Thus, substantially an entire structure can be formed from one type of interlocking block. In addition, the arrangement of the invention allows the two abutting blocks having the half sections of the dovetail to be pressed together to minimize the space taken up by the dovetailed sections as overlapping blocks are being slid onto such dovetail sections. As soon as the overlapping block is slid completely onto or over the dovetailed sections, however, and the force is removed from the ends of the two included blocks, the two blocks tend to separate slightly, effectively binding their dovetails within the opening in the overlapping block with which they are interengaged. Consequently, the overlapping sections securely hold the two cooperating half dovetail sections within them with little tendency of the overlapping block to slide from position. This not only provides a more secure interlocking in a finished wall, but allows the blocks to be partially interlocked together on a surface beside the wall which is being constructed, and allows the several interlocked blocks to be easily picked up and placed upon the wall where they are to be used without said blocks sliding from each other. A considerable saving in time in constructing a wall is thereby attained.

In addition to the blocks being interlocked transversely with each other via the abutment of the dovetailed ends of two blocks and insertion of such two half dovetailed sections into an overlapping block, the blocks are effectively interengaged with upper and lower courses of other blocks by means of the lintels, extending in grooves between two adjacent blocks. Such grooves are designed along horizontal, interlocking axis and the vertical, interengaging axis of each block. Such lintels, which may be formed from various materials including rectangular concrete section, metal pieces, and in many cases, and preferably, rectangular hollow plastic sections which can be used not only to run utilities through the walls or along the walls when the building is being constructed, but also very effectively align a series of blocks with each other reducing the steps necessary to keep the blocks in alignment, also with a saving in time in construction of a wall. Furthermore, since each block preferably has a rectangular groove along both the top and the bottom surfaces when an interlocking wall of such blocks are formed, there will be two lintels available or used on both the top and the bottom of the blocks to interengage the upper and lower courses of blocks with the course in question. One of such lintels, for example, the lintel on the inside, horizontal groove along the wall in a building, can be provided as a hollow tubular lintel for containment of utilities such as electric lines, telephone lines and even water and the like, while the outer, horizontal groove in the blocks can contain a reinforced concrete lintel or other solid or reinforced lintel to add further security against transverse movements of one course of blocks with either an underlying or overlying course of interengaged blocks. Since, furthermore, a hollow lintel in which utilities may be run will always be at a uniform position with respect to the intersection of two superimposed blocks, anyone desiring to gain access to the interior of a hollow lintel to hook up with utilities such as, for example, an electrician, can easily drill a hole in the side of two superimposed blocks to gain access to the grooved passageways containing the hollow lintel and allow the utilities therein to be accessed. If desired, therefore, spaced half-round orifices can be provided in the tops and bottoms of the blocks so that there is already an opening through which access to utilities can be had. In an alternative embodiment of the invention, "knock-out" portions can be fabricated into the tops of the blocks to provide openings for access to the groove passageways.

The interlocking of the blocks of the invention also provides a convenient arrangement for making use of a combined insulative and structural wall in which one row of the interlocked blocks may be formed from an insulative concrete material such as disclosed in U.S. Pat. No. 4,780,433, previously issued to the present inventor, and the adjoining row of interlocked blocks may be formed from a regular load supporting or structural concrete material. Adjoining courses of interlocked blocks built up, one upon the other, will then usually have the outside row of blocks formed from structural materials such as normal concrete and the inner row formed from an insulative concrete material which may, while it has a very much enhanced insulative factor, be also less able to sustain a high structural weight. Consequently, the outer row of blocks will be arranged to support the major weight placed upon the wall by superimposed structures such as the upper floors or roof of a building or the like, while the inner courses of interlocked blocks having the high insulative value, but less structural integrity, will be arranged only to support the weight of overlying blocks. The insulated section, through which the hollow utility lintel will normally pass, will also be easier to drill through to gain access to such utilities in the lintel. While the insulated blocks may have less strength, it has been found that the strength of the half dovetail sections at each end of the blocks is sufficient to cause effective interlocking of the outer layer, or row, of structural blocks to each other through interlocking of the inner row of structural blocks. However, as an alternative, if additional strength is desired in the half dovetail sections, half of the block on the dovetail side of such block can be formed of ordinary structural concrete while the opposite side of the block can be formed of insulated material. While this decreases the amount overall of insulated material in the wall, it will increase the amount of structural concrete material in the wall. A still further embodiment, of course, would be to form an entire wall from a series of uniform blocks each having the inner section of the block formed from structural material, including the half dovetail section and the outer section of the block formed from insulative concrete material. This would provide an insulating layer on both the inside of the wall and the outside of the wall and the structural sections along the inside of the wall. While this would tend to be less effective in cold weather, when the outer sections are exposed directly to the cold outer air and transfer of heat tends to be from inside the building to the outside, the reverse tends to be true in the summer when the outer insulative layer insulates the whole building from the heat of the outside and the inside layer provides a backup to such outer layer. This principle also operates with the "garden" block embodiment, with the top soil providing the extra insulation.

A further way of reinforcing the blocks of the invention is to run a reinforcing material through the blocks and into the half dovetail sections. This may be done in several manners, but one very effective manner may be to run a structurally reinforcing mesh through the block with the ends turned up or to the side to enter into the half dovetail sections. Other reinforcing arrangements may also be used, for example, small conventional reinforcing bars may be placed longitudinally in the block with short sections of such reinforcing bars extending transversely in the ends of the block into the half dovetail sections. Various other interlocking configurations will occur to those skilled in the art. The unifying principle in each case, however, is that the outer end of each dovetail will be easily abutted against an opposing dovetail of an adjoining interengaged block and the two dovetails then inserted into a conforming dovetailed groove section in the central portion of an identical conforming block. Other arrangements for reinforcing will occur to those skilled in the art.

The present invention also encompasses the use of the half dovetail section interlocking blocks as the rear section of a garden-type block having an outwardly extending planter arrangement, i.e. having a hollowed out upper section in which plant materials and the like may be placed. It has been found by the present inventor that such garden blocks tend not to be good environments for the growing of plants because the concrete block acts as a heat transfer medium which, when exposed to the sun, essentially transfers heat to the roots of the plants, not only drying out such roots and surrounding earth, but also essentially cooking them over a period, a condition which is not conducive to continued growth and viability of many, if not most, plant species. The present inventors have discovered that the detrimental conduction of heat from the exterior of the block to the interior can be considerably decreased by making the planter portion of the block from the insulated concrete while the remainder of the block is formed from normal structural-type concrete. Alternatively, only the inside of the depression in the garden block can be formed of the insulative concrete to prevent transfer of heat from the exterior to the roots of the plant material. While it is preferred for the insulated garden block of the invention to be one of the interlocked blocks of the invention, it is not necessary for such interlocking to be the interlocking provided here, since other interlocked garden blocks may be used, so long as the garden part of the block is insulated as described. Furthermore, in some cases, the garden block need not even be interlocked or even interengaged with adjacent blocks, but can be essentially an ordinary built-up block in which a series of blocks are held together essentially by mortar and the weight of overlying blocks to keep them in a superimposed wall structure.

While a more or less conventional dovetail arrangement having basically partial triangular sections to interlock with adjacent sections is a preferred arrangement of the invention, any other regular shape of half dovetailed sections may be used. For example, dovetails may be rounded off, and even made more or less bulbous. Other rectangular shapes may also be used for the rectangles. Some of these variations of the invention will become more evident from a close study of the attached drawings in conjunction with the following more detailed description of the preferred embodiments and variations thereof.

Figure 1B:
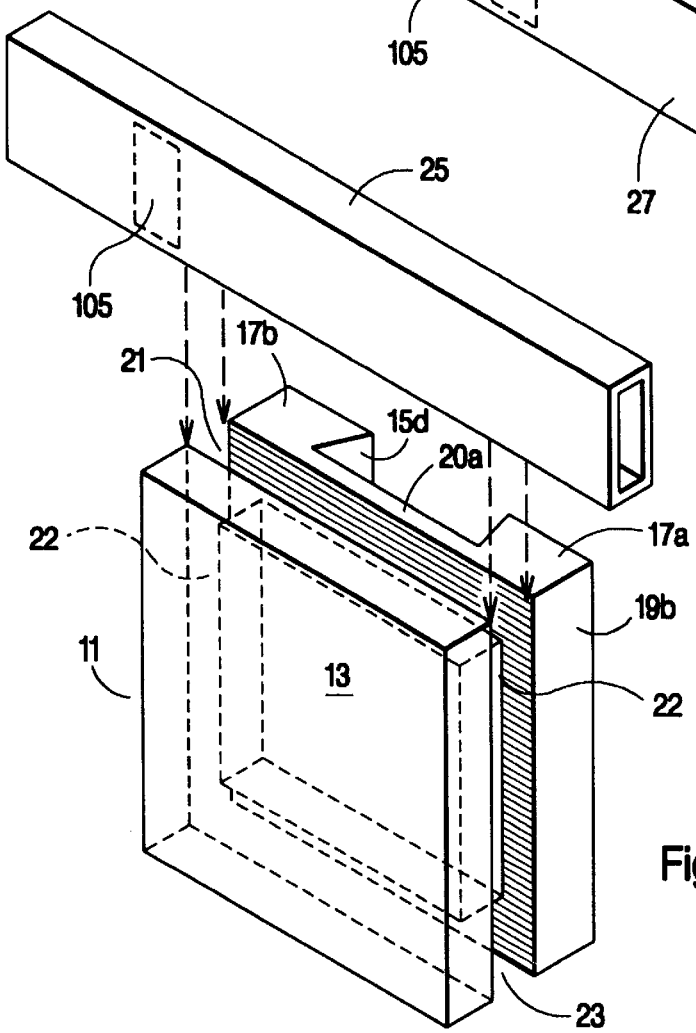

FIGS. 1A and 1B are isometric views from opposite sides of a concrete block 11 in accordance with the present invention. Block 11 has an outer face 13, shown more particularly in FIG. 1B, and an inner face 15, shown more particularly in FIG. 1A. Block 11 is preferably square along each face, however, an oblong arrangement can be equally operable. As previously discussed, a block 11 with a square cross section, as opposed to a block 11 with an elongated cross section in either the longitudinal or transverse direction, reduces and effectively overcomes inconsistencies brought about by differing tolerances inherent in the construction of the block 11. However, oblong-shaped blocks with minimal inconsistencies in tolerance, approximately 1/16th of an inch, would interlock and interengage in an equivalent (to the square embodiment) manner. The face 15, which constitutes the interlocking face of the block 11 is formed of five individual faces 15*a*, 15*b*, 15*c*, 15*d* and 15*e*, such faces being positioned at two different levels and several angular orientations. The two sectional faces 15*a* and 15*e* constitute the outer faces of two interlocking or half dovetail sections 17*a* and 17*b*. The block 11 also has two planar ends, 19*a* and 19*b*, which extend over the entire end of the block, including the ends of the half dovetail sections 17*a* and 17*b*. A top, horizontal groove 21 and a bottom, horizontal grove 23 extend longitudinally along the top surface 20*a* and bottom surface 20*b* (not shown) of the block 11, while parallel, vertical grooves 22 extend transversely along each end 19*a* and 19*b*. The combination of the parallel, horizontal grooves 21 and 23 and the parallel, vertical grooves 22 results in a continuous circumferential groove around the block 11. The parallel, horizontal grooves 21 and 23 are provided to receive longitudinal members, or lintels, 25 and 27 which serve to both interengage the superimposed courses of blocks 11, i.e. to retain the upper blocks in alignment with lower blocks, and also to provide a longitudinal alignment of consecutive blocks as they are laid down in a single course. The lintels 25 and 27 are shown adjacent the blocks in FIGS. 1A and 1B, with directional arrows showing placement of said lintels in the grooves in the top and bottom of the blocks and, as explained hereinafter, it is almost impossible, when using the lintels 25 and 27 in the grooves in the top and bottom of the blocks, to lay the blocks other than in a straight line. This in itself saves a great deal of time in laying the interlocked blocks of the invention. The parallel, vertical grooves 22 act in conjunction with the parallel, horizontal grooves 21 and 23 to form an enhanced network of passageways for the placement of utility line conduits and the like, and potentially utilize a lintel embodiment (not shown) which accommodates both horizontal and vertical grooves at once. Transmission of utility conduits or the like, between the horizontal and vertical grooves while incorporating hollow lintels 25 and 27, could be accomplished through small cut-out portions or perforations 105 in the lintels 25 and 27 where the longitudinal lintels 25 and 27 intersect with the parallel, vertical grooves 22. A groove dimension (horizontal or vertical) of preferably about 1¾ inches±½ inch has been found to be satisfactory for providing sufficient room for normal utility conduits.

Figure 2:
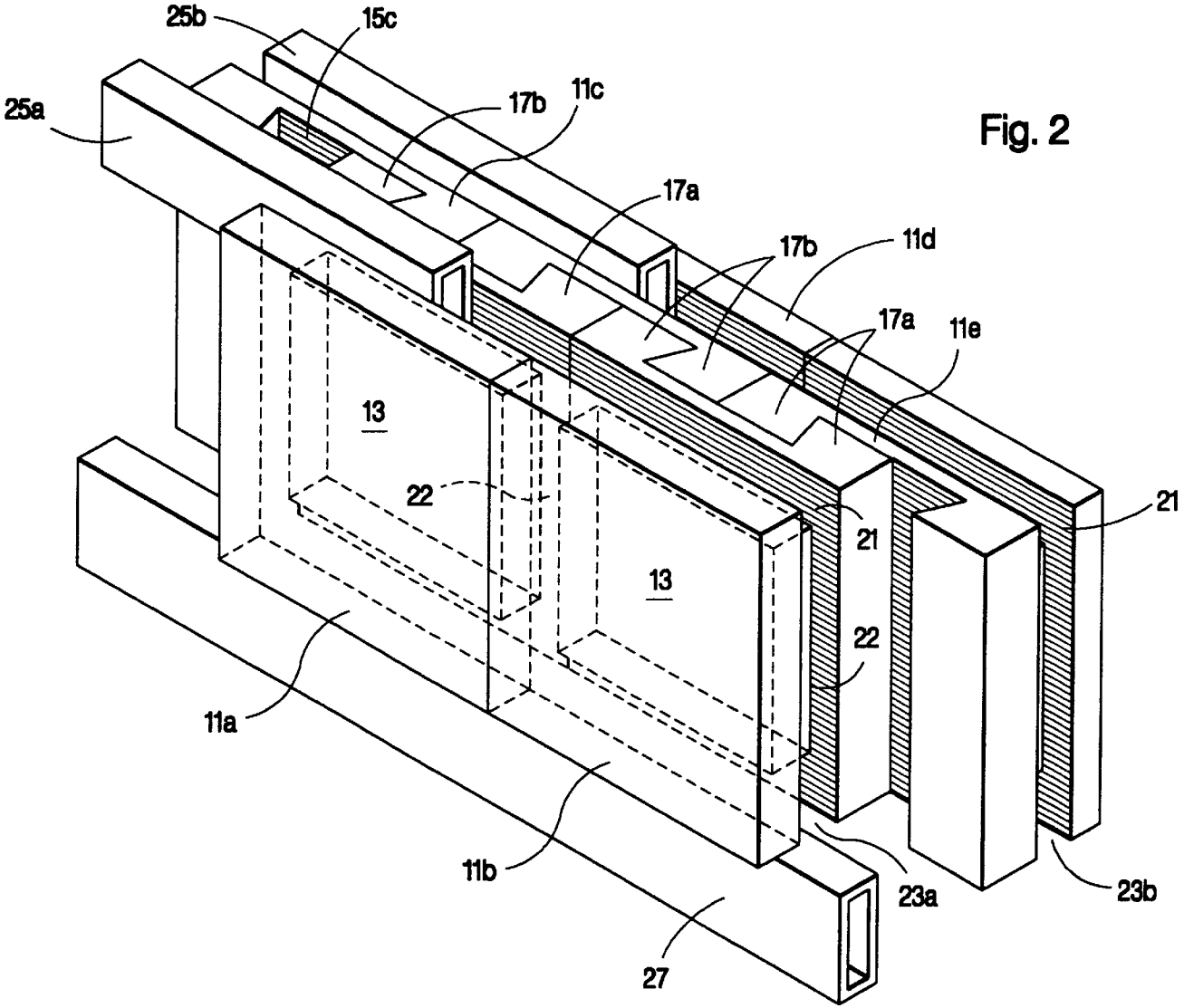
FIG. 2 is an isometric view of four of the blocks of the invention interlocked with each other together with rectangular lintels which form a sort of tongue and groove interengaging arrangement with upper and lower blocks, not shown.

FIG. 2 is an isometric view of a series of blocks identical to the blocks shown in FIGS. 1A and 1B interlocked together to form a short section of wall. In FIG. 2, it will be seen that a series of five identical blocks, as shown in FIGS. 1A and 1B, have been interlocked with each other to form a section of wall formed of two courses of blocks in which the front blocks 11*a* and 11*b* are interlocked with the rear blocks 11*c*, 11*d*, and 11*e*. A lintel or longitudinal section 25 is supplied on the top of each block in the horizontal groove 21, and a second lintel 27 is provided at the bottom of each block in the parallel, horizontal groove 23. Parallel, vertical grooves 22 are provided by the adjacent placement of a pair of blocks, e.g. 11*a* and 11*b*, together in interlocking relationship with reversibly oriented block, e.g. 11*d*. The parallel, vertical grooves 22 formed by the interlocking combination of three blocks, e.g. 11*a*, 11*b* and 11*d*, is produces a staggered, vertical groove arrangement along the longitudinal axis of the interlocking blocks. Thus, the vertical groove 22 formed by the interlocking of the blocks 11*d*, 11*e* and 11*b* is longitudinally situated approximately one half the longitudinal distance of the face 13 from the vertical groove formed by the interlocking of the three blocks 11*a*, 11*b* and 11*d*. This staggered placement of vertical grooves, interconnected at their ends with the longitudinal grooves, forms a unique network of passageways within the interlocked wall for the containment of utility conduits and the like.

In FIG. 2, the upper lintels 25 within the horizontal grooves 21 can be more particularly defined as a nearer, upper lintel 25*a*, where nearer lintel 25*a* is located toward the inner surface of the wall, and a farther, upper lintel 25*b*, which is farther from the inner surface of the constructed wall and closer to the outer surface of the constructed wall. The lintels 25 are shown only partially complete. A bottom lintel 27*a* is shown extending across the entire length of two contiguous, interlocked blocks in lower, horizontal groove 23, while no lintel is shown in the far groove 23. On the top of the blocks, a partial lintel arrangement is, as noted above, shown toward the left side of the course of interlocked blocks, and it will be understood that in a complete interlocking construction, the lintels 25*a* and 25*b* be will extended normally along the entire length of the horizontal groove 21 formed from the interlocked courses of blocks.

Figure 3:
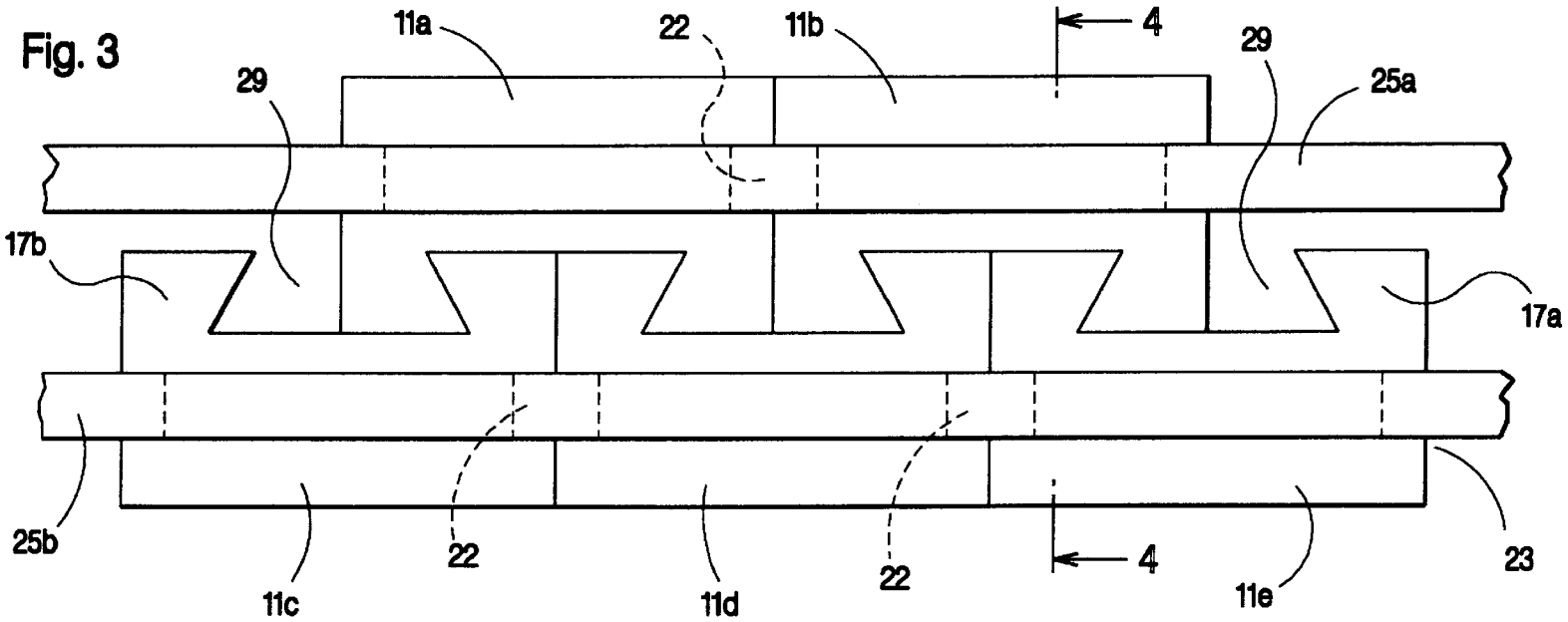
FIG. 3 is a plan or top view of five of the typed interlocking blocks shown in FIG. 1 in interlocked relationship.

FIG. 3 is a plan view of the interlocking arrangement shown in FIG. 2. In FIG. 3 it will be seen that the two top blocks shown in FIG. 2, namely the near blocks 11*a* and 11*b*, are interlocked with three blocks 11*c*, 11*d* and 11*e* by means of the half dovetail sections 17*a* and 17*b* of each block. It may be seen that the various blocks 11*a*, 11*b*, 11*c*, 11*d* and 11*e* fit rather closely together and form an interlocking unit. A close interfit of the various blocks through the insertion of the half dovetail sections 17*a* and 17*b* into the dovetail retaining grooves 29 (see the ends of the blocks 11*c* and 11*e* in FIG. 3) provides the tight interfit to be formed between the various blocks. As can be seen, since the half dovetail sections 17*a* and 17*b* are disposed at the outer surface of the blocks, and the end of the dovetail sections is a continuation of the end of the block itself, when inserting two dovetail sections 17*a* and 17*b*, which are abutted against each other into a dovetail groove 29, the two dovetail sections 17*a* and 17*b* can be forcibly pressed against each other, leaving a certain amount of clearance between the outside and the inside of the dovetail grooves. This allows the two abutted half dovetail sections to be slid together into a dovetail groove 29 in an easy manner. However, when the pressure against the ends of the blocks is relieved, allowing the blocks to readjust slightly away from each other, the half dovetail sections or extensions 17*a* and 17*b* bind within the dovetail grooves 29 so that the dovetail extension 17*a* and 17*b* are essentially caught within the grooves 29 to such an extent that a series of the interlocked blocks can actually be picked up and carried as a unit without danger of the blocks sliding apart. While FIGS. 2 and 3 show a partial section of a wall formed of only five individual blocks and only a single dual course of blocks, it will be understood that in forming a wall, either for a building such as in a house or office building, or a wall outside of such building, that a series of sections of the blocks will be disposed one upon another.

Figure 3A:
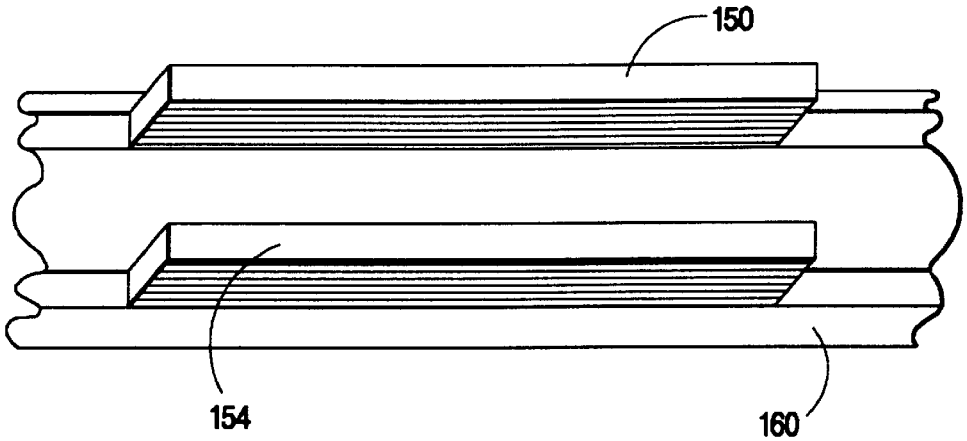
FIG. 3A is an isometric view of a plurality of ground-levelling rails extending from a ground plate for placement and positioning of the initial course of interlocking blocks of the invention upon a planar surface.

FIG. 3A is an isometric view of a plurality of ground-levelling rails 150 and 154 extending from a ground plate 160, for placement and positioning of the first course of blocks upon a planar surface. The levelling rails 150 and 154 are dimensioned to fit within the parallel, horizontal or longitudinal grooves 23*a* and 23*b* (shown in FIG. 2) respectively of a block 11, to secure such block 11 in parallel arrangement with adjacent interlocking blocks along the same course of blocks, and to establish a parallel foundation for future courses of interengaged blocks to be placed onto the first course of blocks. It will become evident that once the initial course of blocks are aligned in a parallel arrangement, all subsequent interengaged courses will conveniently stack in a parallel arrangement without the effort of levelling each interengaged course. These levelling rails are an incredible time saver, since the conventional methodology is to level each course of building blocks as they are laid upon each other; providing a level initial course of blocks and avoiding the need for subsequent levelling measurements.

Figure 3B:
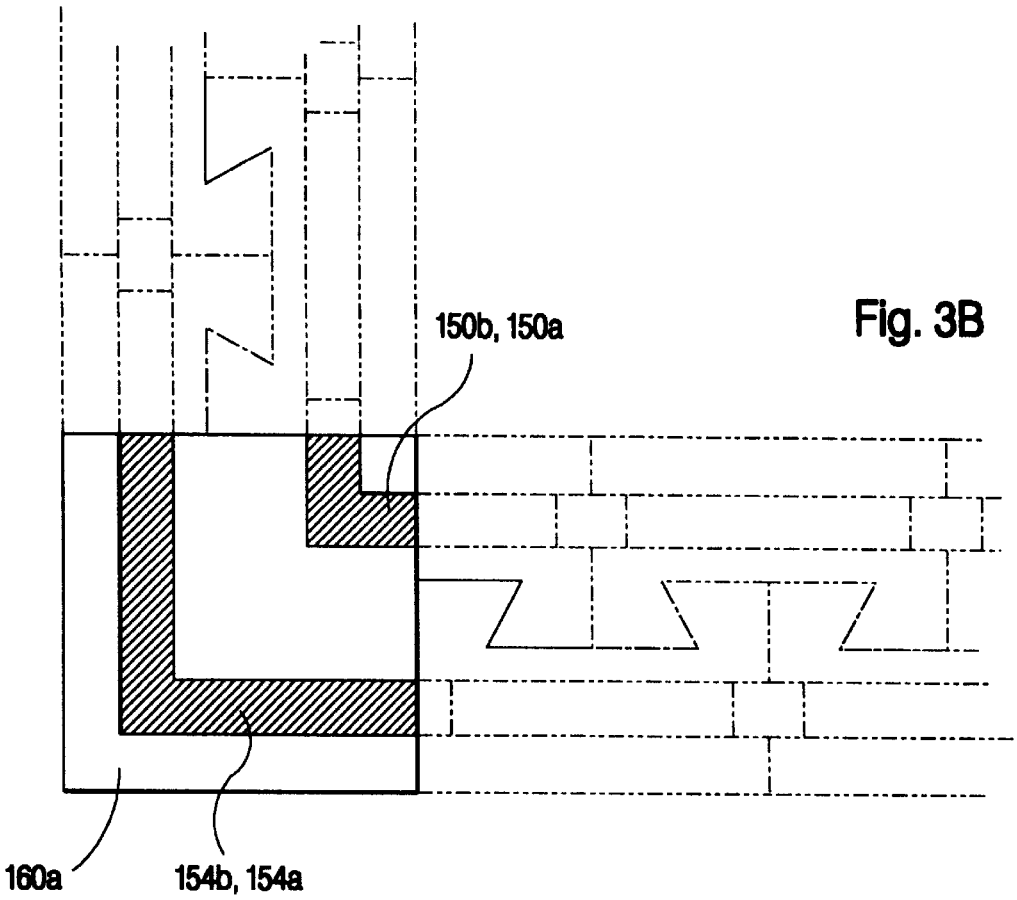
FIG. 3B is a top view of a corner ground-levelling rail section extending from a corner ground plate for placement and positioning of two initial courses of interlocking blocks of the invention upon a planar surface.
Figure 3C:
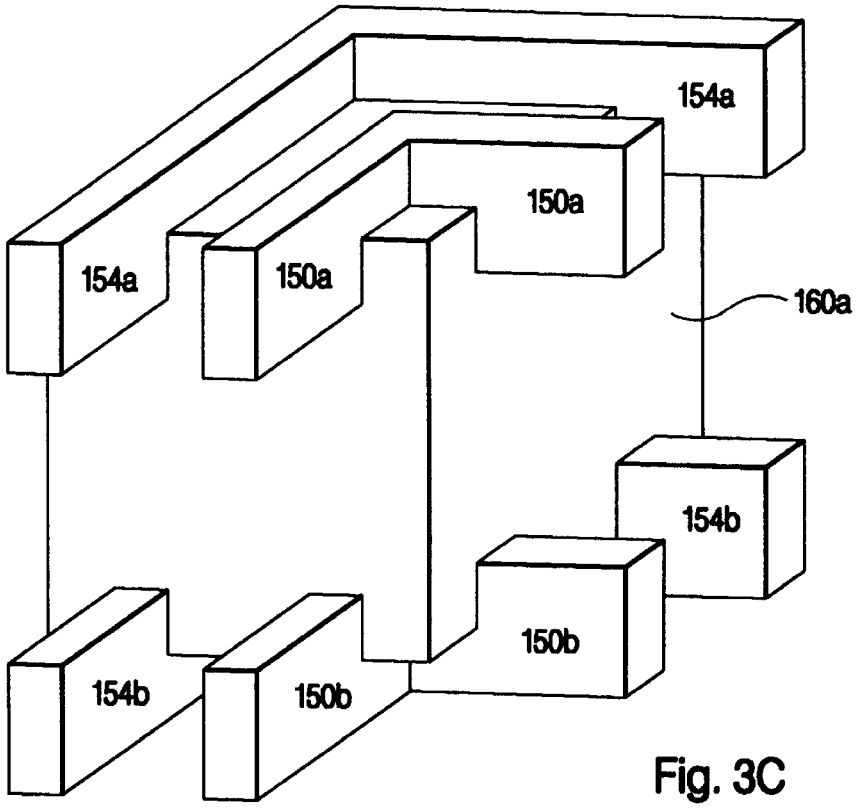
FIG. 3C is an isometric view of a corner ground-levelling rail section for placement and positioning of two initial courses of interlocking blocks of the invention upon a planar surface.

FIG. 3B is a top view of a levelling, corner plate 160*a*, for the interconnection of a first course of interlocking blocks, shown in phantom, with an adjacent first course of interlocking blocks, also shown in phantom. The corner plate 160*a*, as illustrated in FIG. 3C, uses rails 150*a* and 154*a* dimensioned to fit within the parallel, horizontal or longitudinal grooves 23*a* and 23*b* (shown in FIG. 2) and rails 150*b* and 154*b* dimensioned to fit within the parallel, horizontal or longitudinal grooves 21*a* and 21*b* (also shown in FIG. 2) respectively of a block 11. The corner plate of FIGS. 3B and 3C serves the same levelling function as the plate of FIG. 3A, with the further attribute of interconnecting two initial courses of interlocking blocks. The present inventor has found that mere usage of the ground rails 150*b* and 154*b*, without the additional rails 150*a* and 154*a*, in the corner embodiment of FIG. 3C would suffice to interconnect the initial ground courses of interlocking blocks, however, usage of all the rails shown in FIG. 3C provides the best interconnection. Once the ground rail system of FIGS. 3A through 3C is in place throughout the entire wall, construction of the wall becomes fairly straightforward, and the courses of interlocking blocks of the invention are merely interengaged with each other in a parallel arrangement, such parallel arrangement established initially by the ground rails as shown and described above.

FIG. 4 is a transverse cross section of two interengaged blocks 11*e* and 11*b* such as shown in FIGS. 1A and 1B shown along Section 4—4 in FIG. 3. In FIG. 4, the left block 11*e* is shown covering the majority of block 11*b* as it is interlocked with such block as shown in FIG. 3, and therefore surface 15*c*, which is the inner surface of the dovetail opening 15 is shown in phantom by a dotted or broken line. Surfaces 15*a* and 15*e* of block 11*e*, which are the outer surfaces of the dovetail opening 15, are not hidden from view by the transverse cross section of FIG. 4 and are therefore shown as a solid line. The surface 15*c* of block 11*b* coincides with the shown surfaces 15*a* and 15*e* of block 11*e*, and is therefore not shown in FIG. 4. Similarly, surfaces 15*a* and 15*e* of block 11*b* are not shown since they coincide with surface 15*c* of block 11*e* already shown in phantom. The interlocking of the blocks 11*b* and 11*e* results in an average center between the interlocked portions shown by center line 15*f*, as illustrated approximately in FIG. 4, which is approximately midway between the surfaces 15*c* and 15*a* of each block 11*b* and 11*e*. Center line 15*f* defines the central division between the interlocking blocks shown in FIG. 4, as well as any interlocking blocks situated along the wall structure. Since the center line 15*f* does not coincide with any surface within the dovetail opening 15, the interlocking between the blocks is recognized as the strongest along line 15*f* and is not hindered in any way by a connective surface 15*a*, 15*b*, 15*c*, 15*d* or 15*e* within the opening 15.

Such an arrangement is shown as a cross section through a portion of an interlocked wall in FIG. 5 where an upper course of blocks, just two blocks wide as in FIG. 4, are indicated by reference numeral 31, which course of blocks 31 are interengaged with a second, lower course of blocks 33 by means of rectangular lintels 25 or 27 in the horizontal grooves 21 and 23, which, when such grooves are brought together, form a rectangular opening into which the lintels 25 or 27 are disposed. A further, lower course of blocks 35 supporting the blocks 33 is likewise interengaged by virtue of the lintels. It is recognized that the lintels serve to interengage an upper and a lower course of interlocking blocks without providing any vertical, interengaging support, and therefore, the lintels should not comprise a dimensional space greater than that provided by the mating of the horizontal grooves 21 and 23. In other words, the lintels do not support any of the weight between courses of blocks, they merely reinforce the interengagement between the courses of blocks.

FIG. 5 also shows a preferred, vertically staggered relationship between interengaged courses of interlocking blocks, as opposed to the less preferred, vertically aligned relationship as shown in FIG. 5A. Note the alternating, staggered arrangement of the lines 15*c* and 15*e* in FIG. 5. The interengagement occurs between courses of interlocking blocks and is facilitated by way of the longitudinal lintels. As explained previously, though, the weight of the interengaged courses of blocks are distributed directly through faces 20*a* and 20*b* (refer to FIGS. 1A and 1B) of the blocks, and not across the transverse walls of the lintels. This being so, the staggered placement of the interengaged courses of blocks becomes analogous to the staggered placement of courses of bricks within a standard brick wall, and it is therefore preferable to have staggerdly aligned block faces 20*a* and 20*b* as illustrated in FIG. 5. It will be understood, however, that consistently aligned, interengaged block faces as illustrated in FIG. 5A will result in a vertical groove 22 that extends from the top course of blocks to the bottom course of blocks. A continuous vertical groove 22 resulting from the arrangement in FIG. 5A would be preferable if it was desirable to run a conduit or the like in a straight line from the top of the wall to the bottom of the wall.

The unique brick-like network of passageways resulting from the arrangement of FIG. 5, as well as the grid-like network of passageways resulting from the arrangement of FIG. 5A, provides an endless variety of conduit and utility line configurations within any constructed wall. This network of passageways results in the ability to run wires, piping, cable and the like throughout any portion of the wall, with the ability to gain access and to place such wiring or conduits anywhere within the wall with a tolerance of one block width.

Figures 5B, 5C:
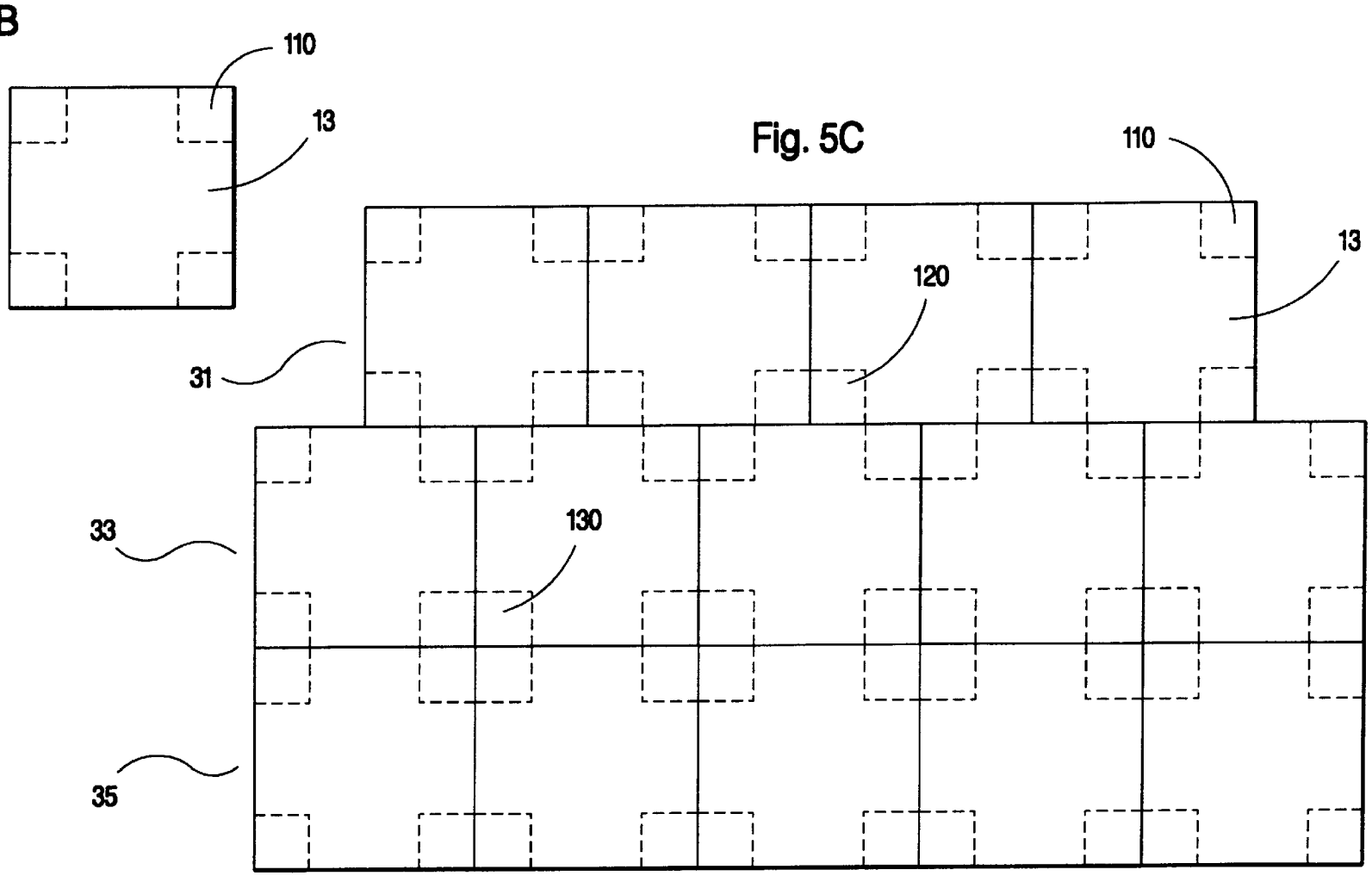
FIG. 5B is a front view of the front face of a block of the invention showing cutout sections for access to the horizontal and vertical grooves circumferentially located around the block.
FIG. 5C is a front view of the front faces of three interlocked courses of blocks of the invention showing the layout of cutout sections within a constructed wall of blocks.

FIG. 5B is a front view of the front face 13 of a block 11 of the invention showing partially cutout or knockout sections at the corners 110 for access to the horizontal and vertical grooves circumferentially located around the block. FIG. 5C is a front view of the front faces of three interlocked courses of blocks 31, 33 and 35. In a staggered arrangement (see FIG. 5) as illustrated by the interengagement of course 31 with course 33, the contiguous cutout portions 110 form a cutout potential 120 that is twice the size of one corner cutout section 110. However, in an aligned arrangement (see FIG. 5A) as illustrated by the interengagement of course 33 with course 35, the contiguous cutout portions 110 form a cutout potential 130 that is four times the size of one corner cutout section 110. The difference in cutout potential governs the type of access and the type of products which may fit within the cutouts. For example, the cutout potential 120 may accommodate the insertion of a single light switch, while the cutout potential 130 may accommodate the insertion of a double light switch. FIG. 5C also illustrates the endless possibilities for future placement of access openings for switches and the like once a wall of blocks has already been constructed.

FIG. 6 is a perspective view of three of the blocks of the invention being slid together in accordance with the invention. The same numbers are used in FIG. 6 to refer to the same structures as in FIGS. 1A and 1B, 2, 3 and 4. The two abutting ends 19*a* and 19*b* of the blocks 11*a* and 11*b* are shown pulled or displaced slightly away from each other to provide emphasis of the unitary nature of the sections and half sections. However, it will be understood that normally when sliding the half dovetail sections 17*a* and 17*b* into the dovetail groove 29, the two dovetail sections 17*a* and 17*b* will be forcibly pressed against each other on their outer surfaces so that the two dovetail sections 17*a* and 17*b* will slide easily into the dovetail groove 29. However, once the half dovetail sections 17*a* and 17*b* have been pressed or slid into the dovetail groove 29, the pressure upon the opposite ends of the blocks is released and the two dovetail sections 17*a* and 17*b* tend to separate slightly from each other effectively securing them by friction on other surfaces within the dovetail groove 29, particularly if the dovetail sections are cocked somewhat as they are removed from the dovetail groove, or start to slide or slip from the dovetail groove. As will be evident, therefore, the interlocking arrangement of the invention provides a very secure interlocking of the dovetail sections in the dovetail groove to interlock the two courses of concrete blocks together and give not only a stronger double course wall, but also a more stable wall.

FIG. 7 is an isometric view of a further embodiment of the invention in which the block is in the form of a so-called "garden wall" block in which the front of the interlocking section is provided with a hollow extension 39 into the hollow or open top 51 of which plants can be placed together with appropriate rooting material. It is desirable that the section 39, as far back as the broken line 41, be formed of an insulated concrete composition which will not transmit heat as readily as regular concrete. Such insulation prevents the heat of the sun shining on the concrete from radiating as intensely to the soil provided within the planting section 51, which heat can become quite substantial when the sun shines on a ceramic block such as that of the invention, frequently killing the root system of any plant community within the garden block. A further embodiment, shown in FIG. 8, of a garden block has a less massive outwardly projecting section of the block and substantially the entire block may be formed from insulating material such as previously described to prevent the heat from the sun and the general environment from heating the earthly material contained within the planter portion 39 of the garden block to a severely detrimental degree as would otherwise occur.

FIG. 8 shows notches 43 in the sides of the garden block section through which a lintel may be passed to tie a series of the garden blocks of the invention together. Again, the entire block may be formed from the preferred insulated-type concrete and may be used in a garden wall type arrangement. A lintel 44, shown more particularly in FIG. 8A in a rectangular configuration and in FIG. 8B in a cylindrical configuration, provided in the grooves 43 of the garden block shown in FIG. 8, may be used to conduct water into the garden block section 39 through orifices 44*a* in the lintel 44 thereby establishing a self-watering, sprinkling system for the flora contained therein.

FIG. 9 is a plan view of the garden block arrangement shown in FIG. 8, while FIG. 10 is a side view and FIG. 11 is a front view or elevation of the "garden"-type block of the invention. It may be seen in FIG. 10 that while the upper groove 21 in the garden block is disposed such as to effectively position any connecting lintels within the upper portion of the planting opening 51 of the planter, the lower groove is disposed in the bottom of the planter portion. In addition, the lower portion of the garden block incorporates a dependent extension 52, also seen in FIG. 12, which fits into the upper portion of the next lower planter section further serving to partially interengage an upper tier of blocks with a lower tier. A drainage orifice 54, shown in FIG. 10 and shown in broken lines in FIG. 11, provides a place for excess liquid to drain from an upper block to a lower block or from a bottom-most block to the environment, either directly or through any suitable formal drainage system.

It will be understood that the garden-type blocks shown in FIGS. 7 and 8 will be combined in use with a series of oppositely oriented interlocking blocks, as shown in previous figures, to form an interlocking double block wall of as many vertical courses as desired with garden blocks on one side and flat surface blocks on the other. All the blocks on the garden side may be planter blocks or they may be interspersed with flat blocks. As a further variation, the planter blocks may be used on both sides of the wall. When used in the wall of a house, the planter blocks or garden blocks will normally be used on the outside of the wall. When used in the wall of a shopping mall, however, the planter or garden blocks will frequently be on the inside or on both sides of the wall.

Figure 12:
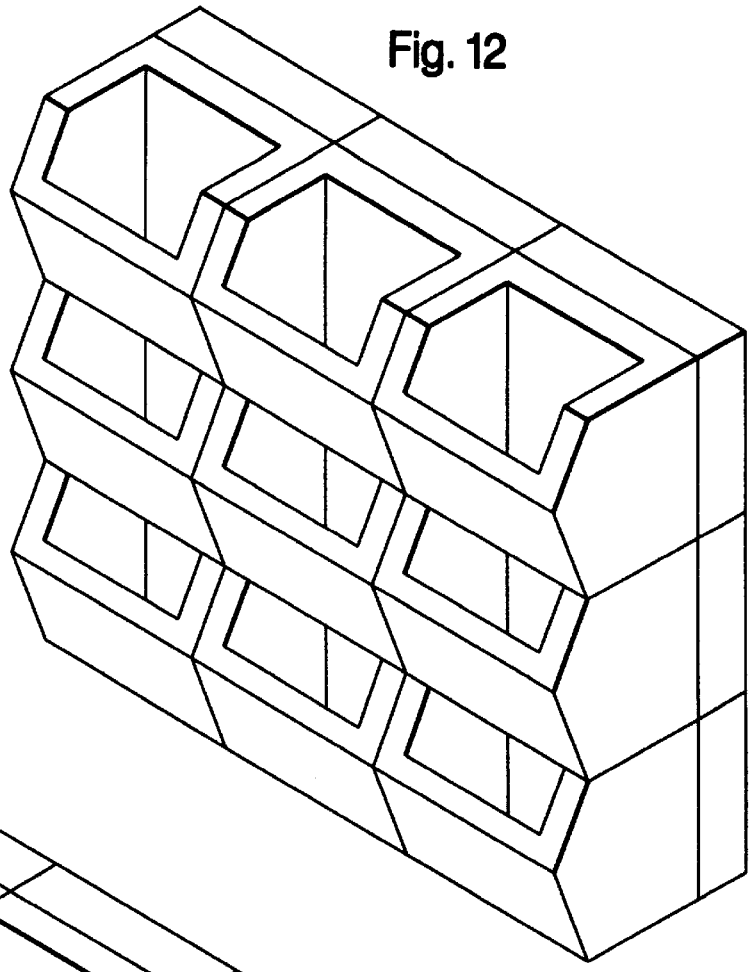
FIG. 12 is an isometric view of a concrete wall formed on the near side of garden blocks in accordance with the invention.
Figure 13:
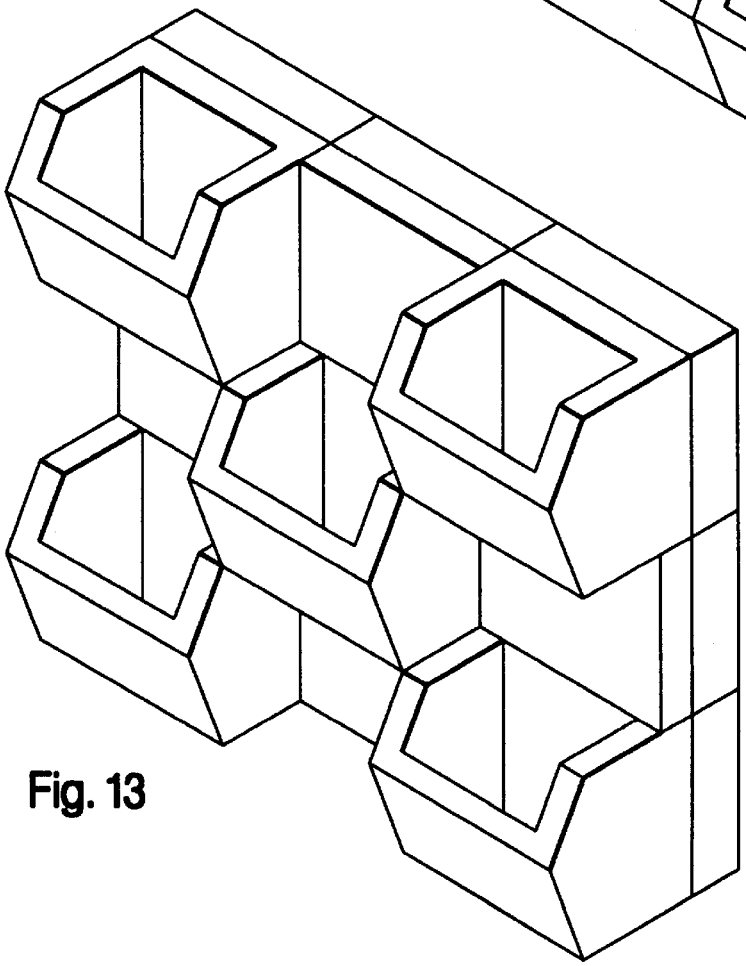
FIG. 13 is an isometric view of a concrete wall formed of garden blocks interspersed with normal block in accordance with the invention.

FIG. 12 is an isometric view of a section of a wall made from the interlocking garden blocks of the invention where substantially every block is a garden block, while FIG. 13 shows a similar wall in which only every second block is a garden or planter block.

Figure 14:
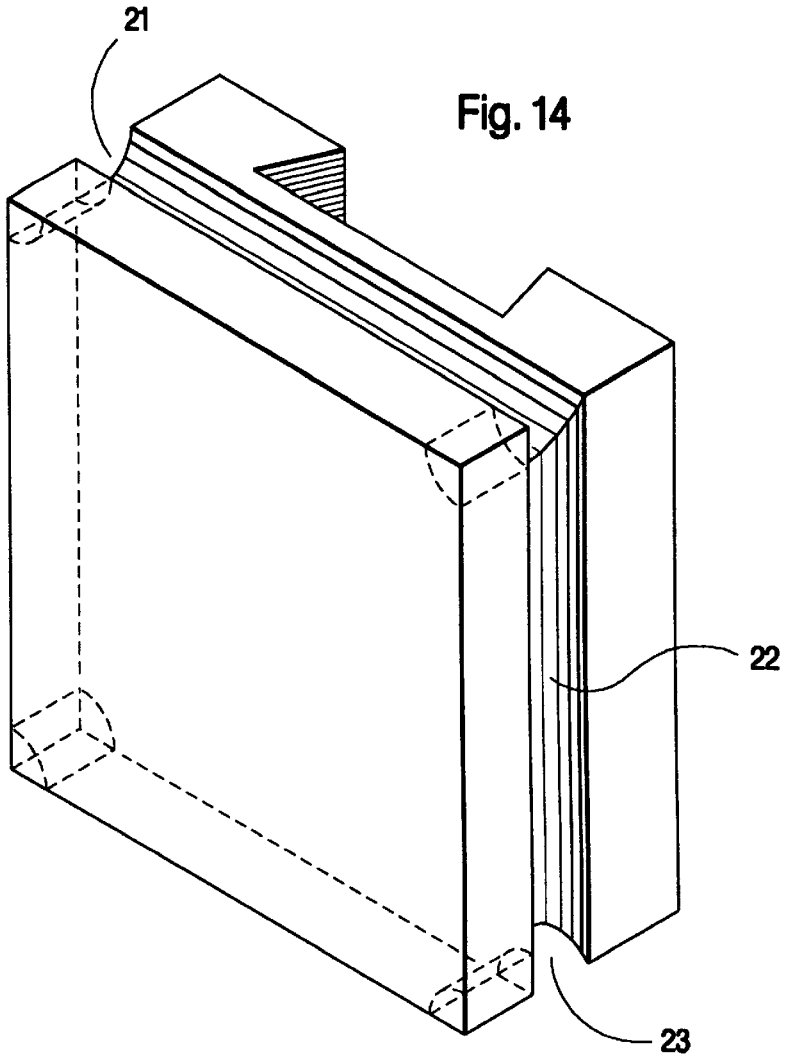
FIG. 14 is an isometric view of a block of the invention showing the use of a lintel orifice other than rectangular in configuration.

FIG. 14 is an isometric view of the block of the invention wherein the parallel, horizontal grooves 21 and 23, and the parallel, vertical grooves 22 have arcuate configurations or arcuate bottom configurations or other curvilinear configurations rather than rectangular configurations. While an angular configuration is preferred to provide additional rigidity between the blocks of upper and lower courses of blocks, it may, in some cases, be preferable to use a round lintel in particular. For examples, where it is desired to use the grooves to contain a water carrying lintel and ordinary plastic pipe or even a metal pipe may be used as the lintel.

Figure 15:
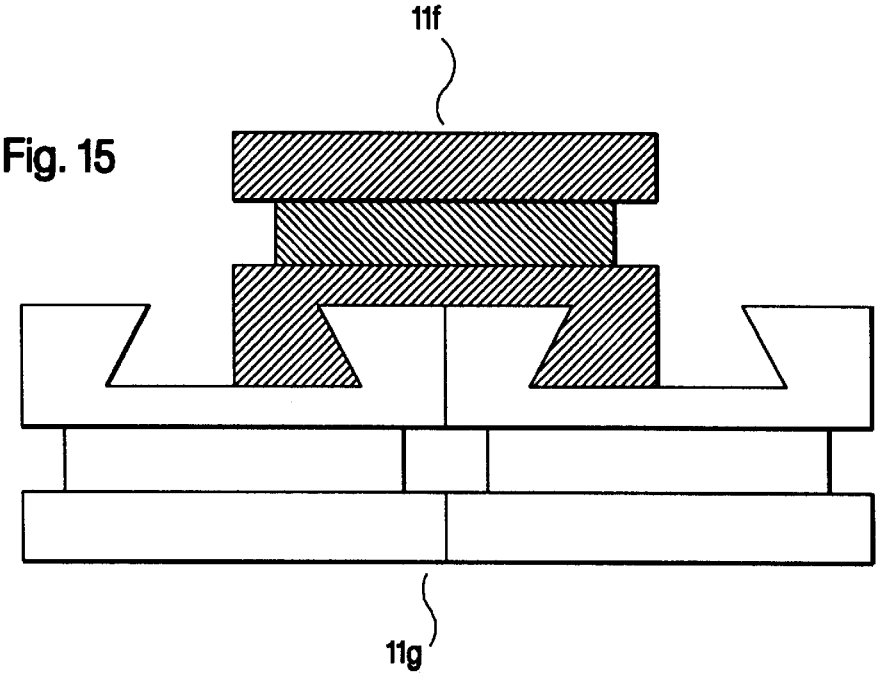
FIG. 15 is a plan view of a partially built wall in which one layer or block layer is formed from insulating concrete, while the other row of blocks is formed from a non-insulating, but higher structural strength row of blocks.

FIG. 15 is a plan view of an interlocking collection of blocks such as shown in FIG. 3, but in which the inner course of blocks 11*f* (shown at the top in FIG. 15) is made from an insulative concrete composition while the outer course of blocks 11*g* is made from a mixed aggregate and normal structural concrete composition. In this manner, a wall may be formed which is both insulative in a portion and structural in another portion. Normally the insulated portion will be on the inside of the wall, if such wall is being used in a building and the structural portion will be used on the outside.

A variation of such arrangement would be to place an insulative material within the outer portion of the planter section, where an inner insulative section prevents heat from being transferred from the outer structural section, which heat may otherwise damage the roots of the plants. The inner insulative section is preferred to be the insulative concrete shown in the other figures. However, the insulative layer may actually be a separate plastic insert formed of an insulative-type material which may be inserted into the structural plastic end of the invention. In accordance with the present invention, therefore, the interior of the structural plastic garden wall block may be formed from an insulative layer such as a separate concrete layer within the planter-type outer layer or may actually be merely a plastic insert which is placed in the concrete planter to prevent excessive heat from being transferred from the structural portions of the wall to the earth in which plants are rooted.

Figure 16:
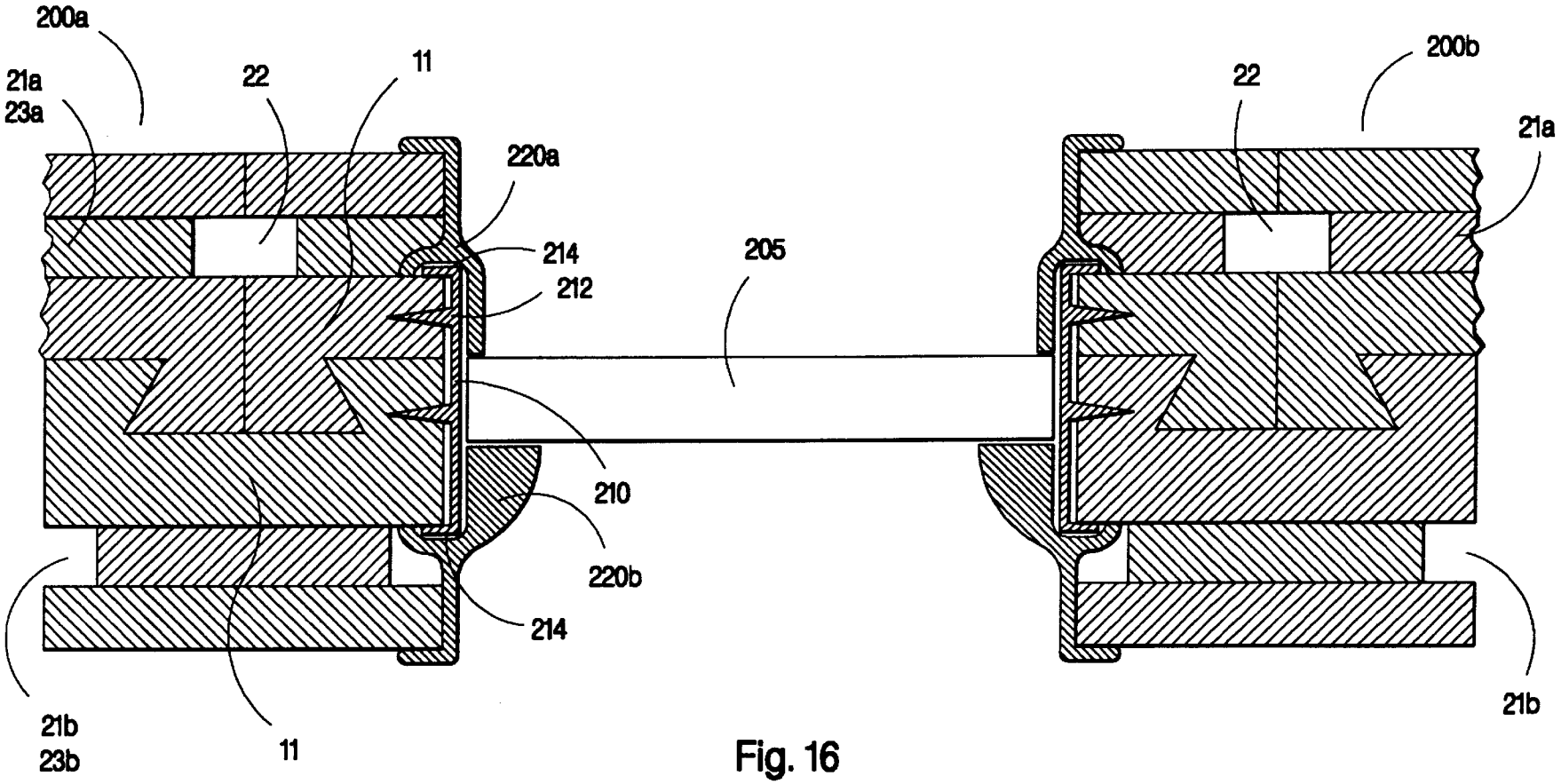
FIG. 16 is a top view of the ends of two courses of interlocking blocks of the invention showing means to create a doorway.

FIG. 16 is a top view of a section of a wall that has been established for use as a doorway. A door 205 spans between a first wall section 200*a* and a second wall section 200*b*, both wall sections 200*a* and 200*b* comprised of courses of interlocking, interengaging blocks of the invention as previously shown and described, with horizontal, longitudinal grooves 21*a* and 23*a* near the interior section of the wall and 21*b* and 23*b* near the exterior section of the wall. A reinforcing plate 210 with fastening elements 212 is securely inserted into the interlocking blocks 11 as shown, and the ends 214 of such reinforcing plate 210 extend into the longitudinal grooves as shown. Removal plastic moldings 220*a*and 220*b* extend the entire length of the doorway and cover the ends of the blocks of the invention, including the longitudinal grooves through which wires, conduits and the like are passed. Enlarged molding 220*b* acts as a doorstop, preventing an overextension of the door 205 about its hinge (not shown), while molding section 220*a* allows for the normal passage of the door 205 about its hinge. Both molding sections 220*a* and 220*b* are removable for access to the grooved passageways located within the block structures of the invention.

FIG. 17 is a top view of a corner end cap 300 for use at the corner of two courses of interlocking blocks 305 and 310 of the present invention. Reinforcing rods 330 and 335 are placed within the longitudinal grooves 21*b*/23*b* and 21*a*/23*a* respectively, which grooves normally serve as passageways for the lintels 25 and 27 (not shown), to further reinforce the interlocking, interengaging structural courses of blocks of the invention. The present inventor has recognized that reinforcing rods 330 and 335 may be used along the majority of courses of blocks, while lintels for transmission of wires and the like, such as 25 and 27 shown in previous figures, may be used, for example, along every other course or along every two courses. It will be understood, however, that structurally superior hollow lintels, made of a material which is similar in reinforcement capabilities as the reinforcing rods 330 and 335, such as, for example, a hollow PVC pipe, could be utilized along every course of blocks, thereby enlarging the avenues of transmissive capabilities throughout the resultant wall construction comprised of interlocking, interengaging blocks.

A corner surface cap 340 is preferably removably connected to the edges of the half blocks 320 and 325 as shown in FIG. 17, which covers an access space 345 for immediate access to either the lintels (not shown) if used, reinforcing rods 330 and 335 if used, or longitudinal grooves 21*b* and/or 23*b*. While the corner block of FIG. 3C is used in at least the first course, or courses, of blocks, the corner end caps 300 of FIG. 17 are used in the majority of the remaining corners, above the block of FIG. 3C, along the corner of a constructed wall. By removing the end cap 340 and revealing the access space 345, one will be able to access the wiring, cable, pipes and the like, and work with such utilities from a convenient location at the corners of the walls without breaking through the walls and disturbing the integrity of the wall surface.

The surface cap 340, while preferably removably connected to the edges of the courses of blocks 305 and 310, should be concealedly connected in such a manner so as to prevent any tampering with the surface cap 340, access space 345 or any of the components therein. The surface cap 340 may therefore comprise an aesthetic facade which creates the impression of permanence for use on the outside corners of a building constructed from the block of the invention. FIGS. 18A and 18B illustrate two possible embodiments for the surface cap 340, and it will be understood that the alternative design configurations are limitless. These surface cap designs provide the means to convert an ordinary, block-like structure into an architectural fashion statement with little or no additional designing involved. It will be understood that this type of surface motif may be implemented around any edge of a resultant wall construction, and therefore, all of the edges, not just the corners, may comprise some aesthetic appeal.

As will be seen from the above, the present invention comprises the provision both of an interlocking-type block having half dovetail sections at the end of each block section, which dovetail sections are shaped or dimensioned so that two of them placed contiguously or closely together will be just large enough to fill a central dovetail groove having undercut sides in the central portion of a single block so that each block is interlocked directly with two opposite blocks in the opposite course of a wall construction. In other words, in accordance with the invention, each block has two end half dovetail sections or extensions, one at each end of the block, dimensioned to fit together with a similar dovetail extension of a longitudinally adjacent block within a central dovetail groove between the dovetail extension of a laterally adjacent block having substantially identical end oriented dovetail interlocking sections.

The second aspect of the invention is to have parallel, horizontal and parallel, vertical grooves circumferentially located around the block under the outer face of the block. The horizontal, longitudinal grooves along both the top and the bottom in a parallel arrangement of a block may each receive a longitudinally oriented lintel which is effective in bridging the intersection of an upper and lower course of blocks so that the upper course of blocks is directly interengaged with a lower course of blocks. The parallel, vertical grooves along the sides of each block are provided for passage of, among other things, utility lines, pipes, wire conduits and the like which may be carried along the longitudinal lintels should such longitudinal lintels be hollow. The combination of the interlocking of the sides of the blocks together by half section dovetailed extensions and full section dovetail grooves, plus parallel, horizontal grooves passing at least on the top and the bottom of the block, each arranged to receive a longitudinal lintel or the like to both interengage the top and bottom courses and also to prevent courses of block being laid down from becoming misoriented and extending slightly to one side or the other, provides a simple, highly practical, interengaging wall structure with many advantages. The invention also encompasses the use of so-called "garden" block sections or extensions on the interlocking blocks of the invention.

The use in the block of the invention of the interlocking end position half dovetail sections plus the use of the grooves for the longitudinal lintels, effectively produces a block which is interengaged on all sides with abutting adjacent blocks as well as being interlocked on several sides by dovetail extensions at the end of each block section, which dovetail sections are shaped or dimensioned so that two of them placed contiguously, or closely together, will be just large enough or correctly dimensioned to fill a central dovetail undercut groove in the central portion of a single laterally adjacent block so that each block is interlocked directly with two opposite blocks in a laterally contiguous row of blocks. As will be evident, the present invention provides a method of interlocking concrete blocks in walls and making such walls practical for residential building and also commercial building. The invention also encompasses the use of insulated concrete or other similar material to provide a course of blocks made from an insulating material and a course of blocks made from a normal structural concrete material and in this way providing a wall having insulation characteristics and load bearing characteristics.

An incidental benefit of the combination of interlocked, interengaged blocks, each block having circumferentially arranged, parallel horizontal and vertical grooves, is the network of passages available for the transmission of utility lines, pipes, cable wires and the like. This network of passageways does not interfere with the structural integrity of the constructed wall, due in part to the staggered arrangement of interengaged courses of blocks acting in concert with the inherent strength contributed by the interlocking connection between the blocks. A unique, and highly convenient number of possibilities for present and future placement of, for example, utility boxes and light switches and the like, arises as a result of this network of passageways.

A preferred lintel arrangement of the invention involves the use of hollow lintels within the longitudinal grooves to interengage upper and lower courses of blocks, through which utility lines may be passed or which serve as utility conductors, such as, for example, aqueous liquid conductors, themselves. In order to take full advantage of this network of passageways, the longitudinal lintels would have to be perforated in some fashion where each longitudinal lintel intersects with a vertical groove. This perforation could then be removed allowing the utility lines and the like to pass from the longitudinal lintels into the vertical grooves and to a desired, resultant place of use.

The preferred form of the half dovetail projections extending laterally from one side of both ends of the block of the invention takes the form of an undercut trapezoidal shape, i.e. a quadrilateral having two parallel sides. However, the dovetail sections of the invention can be other than trapezoidal.

The insulated concrete used in some versions of the invention will be formed at least in part of some insulative material essentially containing dead air spaces or other insulative substances which exhibit a lesser heat transfer than normal concrete components, preferably as described in U.S. Pat. No. 4,780,433.

While the present invention has been described at some length and with some particularity with respect to several described embodiments, it is not intended to be limited to any particulars or to any particular embodiment, but is to be construed broadly with reference to the appended claims so as to provide the broadest possible interpretation of such claims in view of the prior art and therefore to effectively encompass the intended scope of the invention.

I claim:

1. An assembly formed of a plurality of identically constructed, interengaged structural blocks wherein a. each structural block comprises:

(i) an insulating concrete composition, (ii) a planar face having four corners, with lateral-side extensions at opposite ends of the structural block each having a half dovetail configuration thereby defining a pair of first and second surfaces, the second surfaces having a generally planar profile and constituting an abutment edge of each side extension for abutment with adjacently located, interengaged structural blocks, (iii) a central depression extending between the pair of first surfaces and defining between such half dovetail configuration extensions a dovetail groove having a configuration and dimensions adapted to receive and interlock with two oppositely disposed adjacent half dovetail configuration extensions from opposite structural blocks, (iv) intersecting parallel, horizontal and parallel, vertical grooves extending circumferentially around the block and located beneath the face of the block where the horizontal grooves extend within the first surfaces of the structural block and the vertical grooves extend within the second surfaces of the structural block, b. the abutment edges of a first structural block each being paired with an abutment edge of an adjacent structural block of the same construction and wherein such abutting pairs of half dovetail configuration side extensions are positioned within the central depressions of adjacent structural blocks forming a first course of blocks, at least second course of blocks formed as said first course of blocks, and parallel horizontal and parallel vertical grooves are opposed when each course of structural blocks is formed and consecutively arranged courses of structural blocks are positioned thereupon forming horizontal and vertical chambers between the structural blocks themselves and the courses of structural blocks forming an interlocking double structural block wall arrangement with interior elongated chambers, and c. at least portions of the chambers between the structural blocks themselves and the courses of structural blocks are occupied by longitudinally extending lintels which serve to directly align and interengage the structural blocks with adjacently located abutting structural blocks and with courses of structural blocks comprising the wall arrangement.

2. An assembly in accordance with claim 1 wherein the lintels are hollow and serve at least in part as longitudinal passageways through the wall arrangement for utilities.

3. An assembly in accordance with claim 2 wherein the corners of the planar face of each structural block are perforated to provide access to utilities in the lintels.

4. An assembly in accordance with claim 3 wherein the lintels are perforated at the crossing of the parallel, horizontal and parallel, vertical chambers to provide passage for utilities in the lintels in the horizontal chambers into the vertical chambers.

5. An assembly in accordance with claim 2 wherein the grooves and lintels comprise a rectangular cross section.

6. An assembly in accordance with claim 2 wherein the grooves and lintels comprise a round cross section.

7. An assembly formed of a plurality of interengaged, interlocking structural blocks wherein a. each structural block comprises:

i. an upper, lower, front and rear face, where the rear face comprises laterally extending trapezoidal projections with undercut portions at each end, ii. a central portion of the rear face being depressed or set back between the laterally extending trapezoidal projections, iii. the maximum distance between the undercut portions of the trapezoidal projections at each end of the structural block being such that the laterally extended projections of two contiguous structural blocks having substantially similar projections can be accommodated in an interlocking fashion between the undercut portions of the trapezoidal projections of the structural block iv. a longitudinal groove along both the upper and lower faces adapted to receive longitudinal members to align and interengage each structural block with adjacent structural blocks forming a course of structural blocks, and with similarly and adjacently arranged structural block courses, b. a course of structural blocks being formed by horizontally interlocked undercut trapezoidal projections of the structural blocks and further aligned by the disposition of longitudinal members in the grooves of said structural blocks, and c. wherein the front faces of at least some of the blocks are extended outwardly into an upwardly oriented hollow arrangement, comprising a rear section and an outwardly extending section, adapted to contain plant material.

8. An assembly in accordance with claim 7 wherein plural courses of structural blocks are aligned and interengaged vertically by at least one longitudinal member between said courses of structural blocks.

9. An assembly in accordance with claim 8 wherein at least one of the longitudinal members is hollow to provide a passage for utilities.

10. An assembly interlocking with claim 9 wherein one course of structural blocks of the assembly is formed substantially from a composition of cement and aggregate while an adjacent course of structural blocks is formed of cement and an insulating aggregate having air pockets in it for insulation purposes.

11. An assembly in accordance with claim 7 wherein the outwardly extending section of the hollow arrangement is formed of concrete made from cement and a porous insulating aggregate and the rear section is formed of a concrete made from cement and a substantially solid aggregate.

12. An assembly in accordance with claim 7 wherein the longitudinal members are in the form of tenons extending within and between the grooves in the upper and lower faces of the structural blocks within a course of structural blocks as well as the adjacent course of structural blocks.

13. An assembly in accordance with claim 12 wherein each tenon has orifices in it for receiving irrigation liquid for passage through the orifices and into the hollow arrangement.

14. An assembly in accordance with claim 7 wherein the structural blocks having extended front faces are arranged in a course of structural blocks in a regular repeating pattern.

15. An assembly in accordance with claim 14 wherein the front face of every other structural block within a course of structural blocks is extended out into a partitioned hollow block structure.

* * * * *